US011229338B2

(12) United States Patent
Royale

(10) Patent No.: US 11,229,338 B2
(45) Date of Patent: Jan. 25, 2022

(54) HANDHELD EXTRACTION CLEANER

(71) Applicant: BISSELL Inc., Grand Rapids, MI (US)

(72) Inventor: Victoria J. Royale, Charlotte, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/108,026

(22) Filed: Dec. 1, 2020

(65) Prior Publication Data

US 2021/0169284 A1 Jun. 10, 2021

Related U.S. Application Data

(60) Provisional application No. 62/943,442, filed on Dec. 4, 2019.

(51) Int. Cl.

| | |
|---|---|
| ***A47L 7/00*** | (2006.01) |
| ***A47L 5/26*** | (2006.01) |
| ***A47L 11/26*** | (2006.01) |
| ***A47L 11/40*** | (2006.01) |
| ***A47L 9/04*** | (2006.01) |
| ***A47L 9/32*** | (2006.01) |

(52) U.S. Cl.

CPC ..... *A47L 7/0009* (2013.01); *A47L 5/26* (2013.01); *A47L 7/0038* (2013.01); *A47L 9/0477* (2013.01); *A47L 9/322* (2013.01); *A47L 11/26* (2013.01); *A47L 11/4016* (2013.01); *A47L 11/4041* (2013.01); *A47L 11/4069* (2013.01); *A47L 11/4075* (2013.01)

(58) Field of Classification Search

CPC ..... A47L 7/0009; A47L 5/26; A47L 7/0038; A47L 9/0477; A47L 9/322; A47L 11/26; A47L 11/4016; A47L 11/114041; A47L 11/4069; A47L 11/4075

See application file for complete search history.

(56) References Cited

U.S. PATENT DOCUMENTS

| | | | | |
|---|---|---|---|---|
| 4,776,058 A * | 10/1988 | Garner | A47L 7/0038 15/320 |
| 5,367,740 A * | 11/1994 | McCray | A47L 5/26 15/320 |
| 5,507,068 A * | 4/1996 | Fan | A47L 5/26 15/320 |
| 5,599,401 A | 2/1997 | Brosky et al. | |
| 5,799,362 A | 9/1998 | Huffman | |

(Continued)

FOREIGN PATENT DOCUMENTS

| | | |
|---|---|---|
| EP | 0847721 A2 | 6/1998 |
| WO | 2016029967 | 3/2016 |

(Continued)

*Primary Examiner* — Dung Van Nguyen

(74) *Attorney, Agent, or Firm* — Warner Norcross + Judd LLP

(57) ABSTRACT

A handheld extraction cleaner includes a unitary body provided with a carry handle, and further provided with a supply tank, a recovery tank, and a suction source, all of which are carried on the unitary body. The various components of the extraction cleaner can be arranged for a balanced weight in hand. The supply and recovery tanks are configured to optimize the usable volume within the tanks, among other functions. A powered cleaning head including a removable brushroll is provided on the unitary body.

20 Claims, 18 Drawing Sheets

(56) References Cited

U.S. PATENT DOCUMENTS

| | | | | |
|---|---|---|---|---|
| 6,125,498 | A * | 10/2000 | Roberts | A47L 1/08 15/320 |
| 6,189,178 | B1 | 2/2001 | Roberts | |
| 6,550,098 | B2 | 4/2003 | Roberts et al. | |
| 6,658,693 | B1 | 12/2003 | Reed, Jr. | |
| 6,968,593 | B1 * | 11/2005 | Lenkiewicz | A47L 5/26 15/320 |
| 7,073,226 | B1 | 7/2006 | Lenkiewicz et al. | |
| 7,225,503 | B1 * | 6/2007 | Lenkiewicz | A47L 5/24 15/320 |
| 9,474,424 | B2 | 10/2016 | Moyher, Jr. et al. | |
| 10,624,515 | B2 * | 4/2020 | Bloemendaal | A47L 11/4016 |
| 2002/0073504 | A1 * | 6/2002 | Hall | A47L 1/08 15/320 |
| 2018/0110388 | A1 | 4/2018 | Xia et al. | |
| 2018/0116476 | A1 | 5/2018 | Bloemendaal et al. | |

FOREIGN PATENT DOCUMENTS

| | | |
|---|---|---|
| WO | 2017108089 | 6/2017 |
| WO | 2019053000 | 3/2019 |

* cited by examiner

HANDHELD EXTRACTION CLEANER

CROSS-REFERENCE TO RELATED APPLICATION(S)

The present application claims the benefit of U.S. Provisional Application No. 62/943,442, filed Dec. 4, 2019, which is incorporated herein by reference in its entirety.

BACKGROUND

Extraction cleaners can be embodied as upright units or portable, hand-carriable units. Handheld extraction cleaners can include a cleaning solution supply tank and a recovery tank. These extraction cleaners typically have a vacuum motor that powers an impeller to create low pressure on one side of the impeller and higher pressure on the other side thereof. The recovery tank is typically positioned between the low pressure side of the impeller and a fluid collection nozzle to remove fluid from a surface and deposit it in the recovery tank. It is also known to provide a separate cleaning fluid pump for directing cleaning fluid from the supply tank to the surface.

BRIEF SUMMARY

The invention relates to a handheld extraction cleaner having a fluid delivery system for storing cleaning fluid and delivering the cleaning fluid to the surface to be cleaned and a recovery system for removing the spent cleaning fluid and debris from the surface to be cleaned and storing the spent cleaning fluid and debris.

According to one aspect of the invention, the handheld extraction cleaner includes a supply tank, a recovery tank, and a vacuum motor, all of which are carried on a unitary body having a carry handle, wherein the supply tank is provided in front of the suction motor and the recovery tank is provided below the supply tank and the suction motor, and wherein the recovery tank has a substantially flat bottom end on which the extraction cleaner can be supported in a self-standing or at rest position on a surface.

In certain embodiments, the extraction cleaner has a powered brushroll at a forward end of the body, and the vacuum motor is at a rearward end of the body. Optionally, the extraction cleaner comprises a battery below the carry handle.

In one embodiment, the extraction cleaner has a cleaning head and a neck connecting the cleaning head to a rearward body. A suction nozzle and the brushroll can be provided in the cleaning head. The vacuum motor, recovery tank, and battery can be provided in the rearward body. Optionally, the neck projects forwardly to support the cleaning head away from a surface on which the extraction cleaner is resting, spacing the suction nozzle and brushroll out of contact with the surface.

According to another aspect of the invention, a handheld extraction cleaner includes a supply tank that improves cleaning liquid usage and usable tank volume in multiple orientations. A drain-pipe is provided in the bottom of the supply tank to provide liquid to an outlet of the tank even when the extraction cleaner is tipped forward.

In one embodiment, the supply tank has a pivotally-mounted fill cap. Thus, the supply tank can be filled either on or off the extraction cleaner.

According to yet another aspect of the invention, a handheld extraction cleaner includes a recovery tank that mitigates the chance for spillage and improves usable tank volume in multiple orientations, such as in both an operational position and a storage or at rest position. The recovery tank can have an anti-spill shape which directs dirty liquid away from an inlet opening of the tank when the extraction cleaner is rested on a surface, reducing the change for spillage.

In certain embodiments, the recovery tank includes a tank body having a first portion and a second portion, wherein the first portion of the recovery tank is disposed at an angle relative to the second portion of the recovery tank, and an inlet opening in the first portion of the tank body. The second portion of the tank body can have a bottom surface configured to rest on a horizontal surface to support the handheld extraction cleaner in a horizontal orientation on the horizontal surface. To mitigate spills, the inlet opening can be disposed above the second portion of the tank body when the extraction cleaner is at rest in the horizontal orientation on the horizontal surface to direct dirty liquid away from the inlet opening.

In certain embodiments, the recovery tank has a spring-loaded flapper door that automatically seals an inlet opening of the tank when the recovery tank is removed from extraction cleaner.

According to still another aspect of the invention, a handheld extraction cleaner includes a powered brushroll. The brushroll is operably coupled with a brush drive motor by a drive assembly.

In one embodiment, the brushroll is removable from a brush chamber of the extraction cleaner. A bottom cover or sole plate secures the brushroll within the brush chamber. Removable of the sole plate allows for removal of the brushroll.

In certain embodiments, the brushroll has a handle on a non-driven end of the brushroll to facilitate removal of the brushroll from the brush chamber. Optionally, the brushroll is exchangeable with a different agitator.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION OF THE DRAWINGS

The invention will now be described with respect to the drawings in which.

DESCRIPTION OF EMBODIMENTS OF THE INVENTION

The invention relates generally to extraction cleaners, and more particularly to a portable, handheld extraction cleaner which applies cleaning fluid to a surface and then extracts the applied fluid therefrom.

Figure 1:
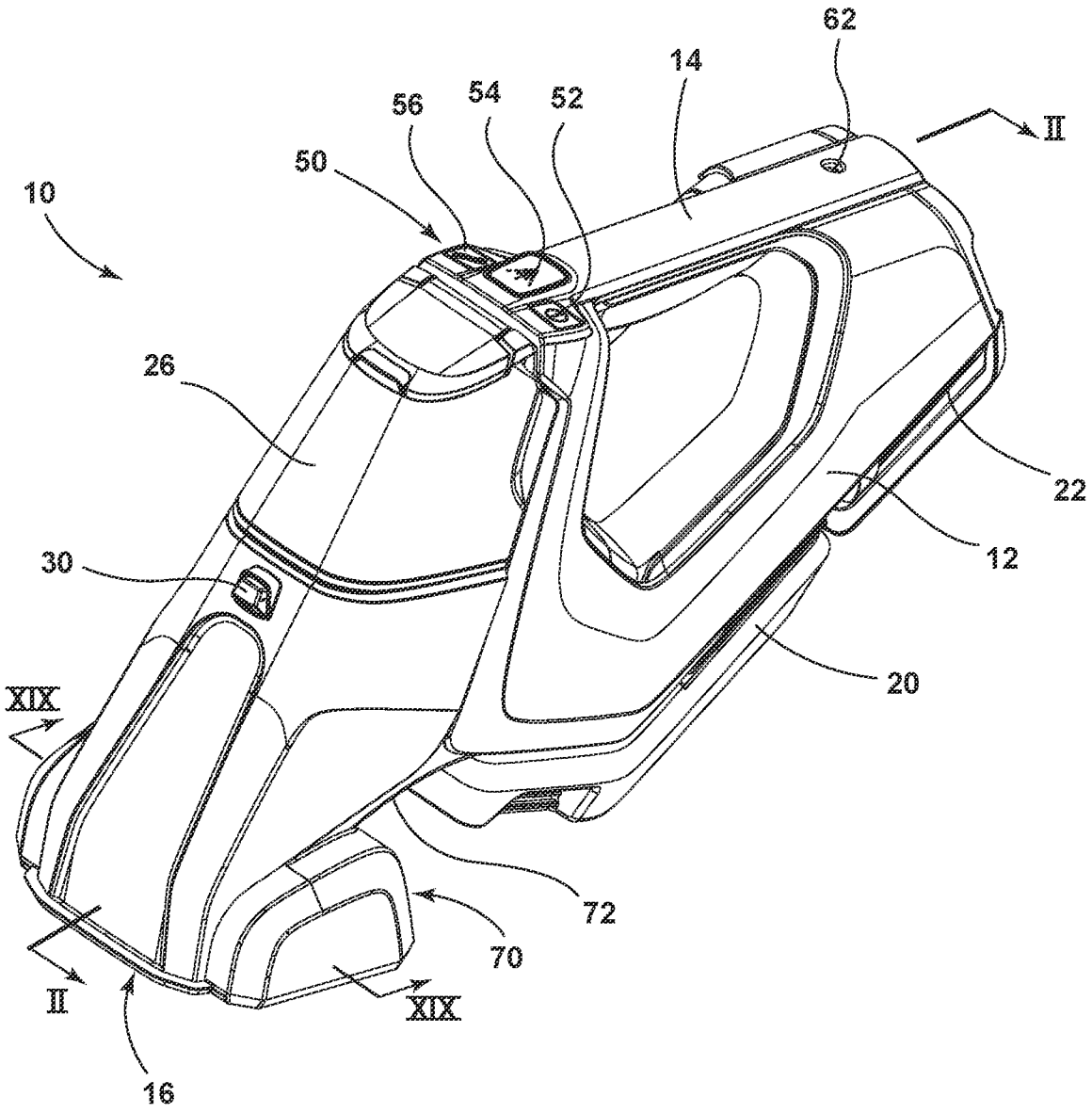
FIG. 1 is a perspective view of a handheld extraction cleaner according to one embodiment of the invention.

FIG. 1 is a perspective view of a handheld extraction cleaner 10 according to one embodiment of the invention. As illustrated herein, the extraction cleaner 10 is adapted to be handheld and portable, and can be easily carried or conveyed by hand. The hand-carriable extraction cleaner 10 can have a unitary body 12 provided with a carry handle 14 attached to the unitary body 12, and is small enough to be transported by one user (i.e. one person) to the area to be cleaned.

For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the extraction cleaner 10, which defines a rear end of the extraction cleaner 10, and carrying the extraction cleaner 10 by the handle 14, which defines an upper end of the extraction cleaner 10. When used in referring to a direction, the term "longitudinal" refers to a direction generally extending along the length of the extraction cleaner 10, between a forward end 66 and a rearward end 68 of the housing 12, and the terms "transverse" or "lateral" refer to a direction generally perpendicular to the longitudinal direction. However, it is to be understood that the invention may assume various alternative orientations, except where expressly specified to the contrary. The use of directional terms should not be interpreted to limit the invention to any specific orientation.

The handheld extraction cleaner 10 comprises a unitary body 12 or housing that carries the various functional systems of the extraction cleaner 10, including a fluid delivery system for storing cleaning fluid and delivering the cleaning fluid to the surface to be cleaned and a recovery system removing the spent cleaning fluid and debris from the surface to be cleaned and storing the spent cleaning fluid and debris. The term "debris" as used herein may include dirt, dust, soil, hair, and other debris, unless otherwise noted. The term "cleaning fluid" as used herein primarily encompasses liquids, and may include steam unless otherwise noted.

Figure 2:
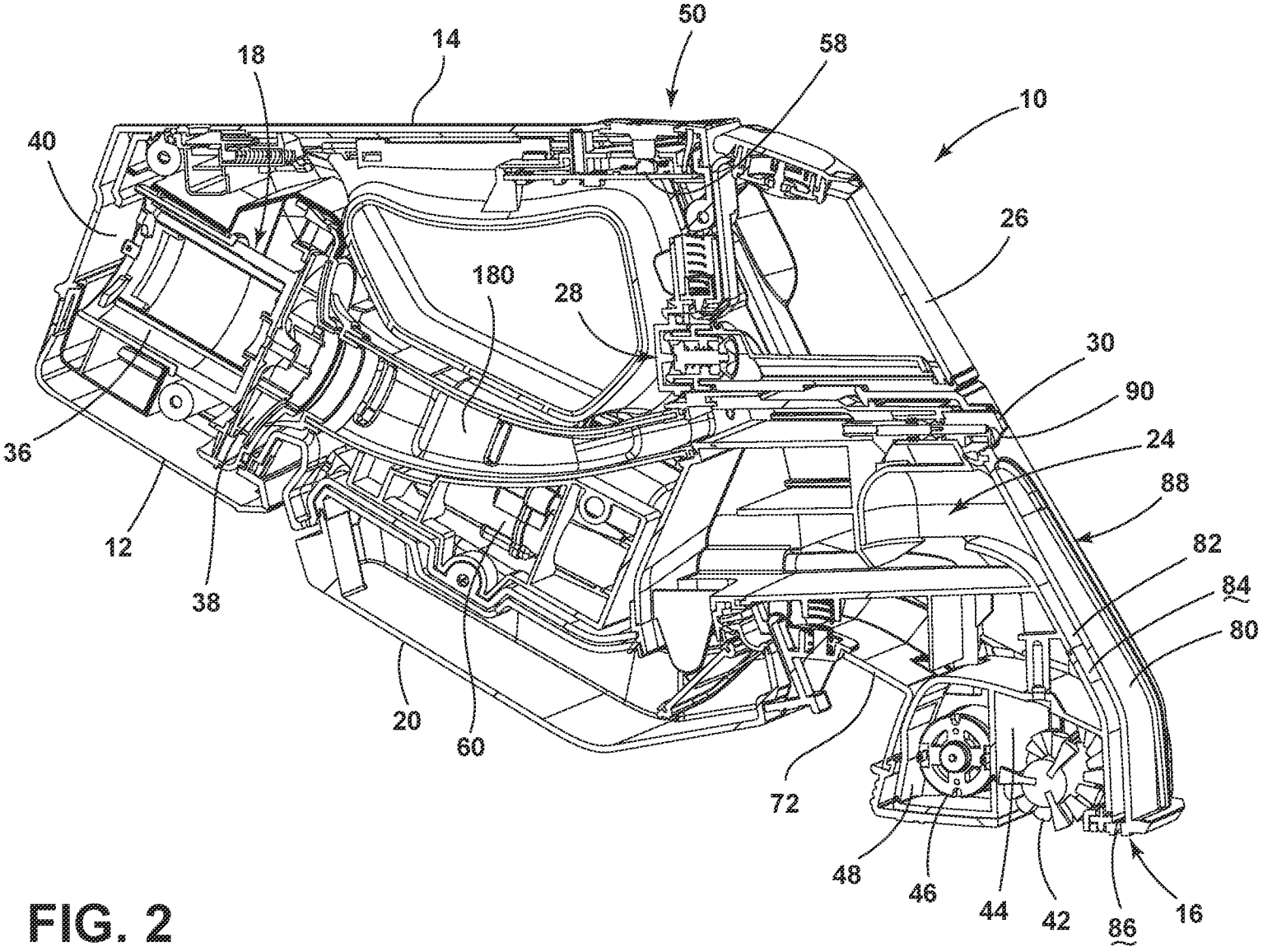
FIG. 2 is a cross-sectional perspective view of the handheld extraction cleaner from FIG. 1, taken through line II-II of FIG. 1.

Referring additionally to FIG. 2, the recovery system can include a working air path through the body 12, and may include a dirty air inlet and a clean air outlet. The working air path can be formed by, among other elements, a suction nozzle 16 defining the dirty air inlet, a suction source 18 in fluid communication with the suction nozzle 16 for generating a working air stream, a recovery tank 20 for separating and collecting fluid and debris from the working airstream for later disposal, and exhaust vents 22 in the housing defining the clean air outlet. The recovery system can further include a separator 24 for separating liquid and entrained debris from the working airstream. The separator 24 can be formed in a portion of the recovery tank 20, or, as illustrated herein, can be separate from the recovery tank 20. The separated fluid and debris can be collected in the recovery tank 20. One suitable separator 24 is disclosed in U.S. Pat. No. 6,968,593 to Lenkiewicz et al., issued Nov. 29, 2005, which is incorporated herein by reference in its entirety. Other examples of suitable separators are disclosed in U.S.

Pat. No. 7,225,503 to Lenkiewicz et al., issued Jun. 5, 2007 and U.S. Pat. No. 6,189,178 to Roberts, issued Feb. 20, 2001, both of which are incorporated herein by reference in their entirety.

The fluid delivery system can include a supply reservoir or supply tank 26 for storing a supply of fluid. The fluid can comprise one or more of any suitable cleaning fluids, including, but not limited to, water, compositions, concentrated detergent, diluted detergent, etc., or mixtures thereof. For example, the fluid can comprise a mixture of water and concentrated detergent. The fluid delivery system can further comprise a flow control system 28 for controlling the flow of fluid from the supply tank 26 to at least one fluid distributor 30. In one embodiment, described in further detail below, the flow control system 28 of the fluid delivery system can comprise a pump 32 (see FIGS. 3 and 6), which pressurizes the system. Optionally, a heater (not shown) can be provided for heating the cleaning fluid prior to delivering the cleaning fluid to the surface to be cleaned. In yet another example, cleaning fluid can be heated using exhaust air from a motor-cooling pathway for the suction source 18.

The suction source 18, which may be a motor/fan assembly, is provided in fluid communication with the recovery tank 20. As shown, the motor/fan assembly 18 includes a vacuum motor 36 and a fan 38. A chamber 40 for the motor/fan assembly 18 can be defined by molded features in the housing 12.

An agitator can be provided adjacent to the suction nozzle 16 for agitating the surface to be cleaned so that the debris is more easily ingested into the suction nozzle 16. As shown, the agitator comprises a powered brushroll 42. The brushroll 42 can be provided at a forward portion of the housing 12 and received in a brush chamber 44. The brushroll 42 is configured for rotational movement about a substantially horizontal rotational axis, relative to the normal use position of the extraction cleaner 10. While a horizontally-rotating brushroll 42 is shown herein, in some embodiments, dual horizontally-rotating brushrolls, one or more vertically-rotating brushrolls, or a stationary brush can be provided on the extraction cleaner 10.

The brushroll 42 can be operably coupled to and driven by a drive assembly including a brush drive motor 46. A chamber 48 for the drive motor 44 can be defined by molded features in the housing 12. The coupling between the brushroll 42 and the drive motor 46 can comprise one or more belts, gears, shafts, pulleys or combinations thereof. Alternatively, the vacuum motor 36 can provide both vacuum suction and brushroll rotation.

The extraction cleaner 10 can include at least one user interface 50 through which a user can interact with the extraction cleaner 10. The user interface 50 can enable operation and control of the extraction cleaner 10 by the user. The user interface 50 can be electrically coupled with electrical components, including, but not limited to, circuitry electrically connected to various components of the fluid delivery and collection systems of the extraction cleaner 10. The user interface 50 can include one or more input controls 52, 54, 56, which can comprise a button, trigger, toggle, key, switch, touch screen, or the like, or any combination thereof. In the embodiment shown herein, one input control 52 is a power input control which controls the supply of power to the vacuum motor 36, another input control 54 is a power input control which controls the supply of power to the pump 32, and another input control 56 is a power input control which controls the supply of power to the drive motor 46. Thus, suction, fluid delivery, and brush rotation can be implemented individually, or in any combination, by operation of the input controls 52, 54, 56. In the embodiment shown, the input controls 52, 54, 56 can comprise on/off buttons in register with a printed circuit board (PCB) 58. The buttons can be provided on a forward end of the carry handle 14 and the PCB 58 can be located within the carry handle 14. The input controls 52, 54, 56 can conveniently be provided on an upper side of the handle 14, at a forward end thereof, for operation of the controls by a thumb of the user's hand that is gripping the carry handle 14.

Electrical power can be provided by a source of mains electricity or by a battery or battery pack. In the present embodiment, the extraction cleaner 10 comprises a rechargeable battery pack 60. An appropriate charger can be provided with the extraction cleaner 10. A charging port 62 can be provided on the housing 12 and can be electrically coupled with the battery pack 60. In the illustrated embodiment, the charging port 62 is provided on a rear end of the carry handle 14. A storage and recharging cradle (not shown) can mount the extraction cleaner 10 when not in use, and can include a recharging connector that couples with the charging port 62 and an electrical cord electrically connected between the recharging connector and an AC/DC transformer that can be plugged into an electrical outlet for supplying DC recharging current to the battery pack 60. In an alternative embodiment, the extraction cleaner 10 can have charging contacts on the housing 12, and a docking station (not shown) can be provided for docking the extraction cleaner 10 for recharging the battery pack 60.

Figure 3:
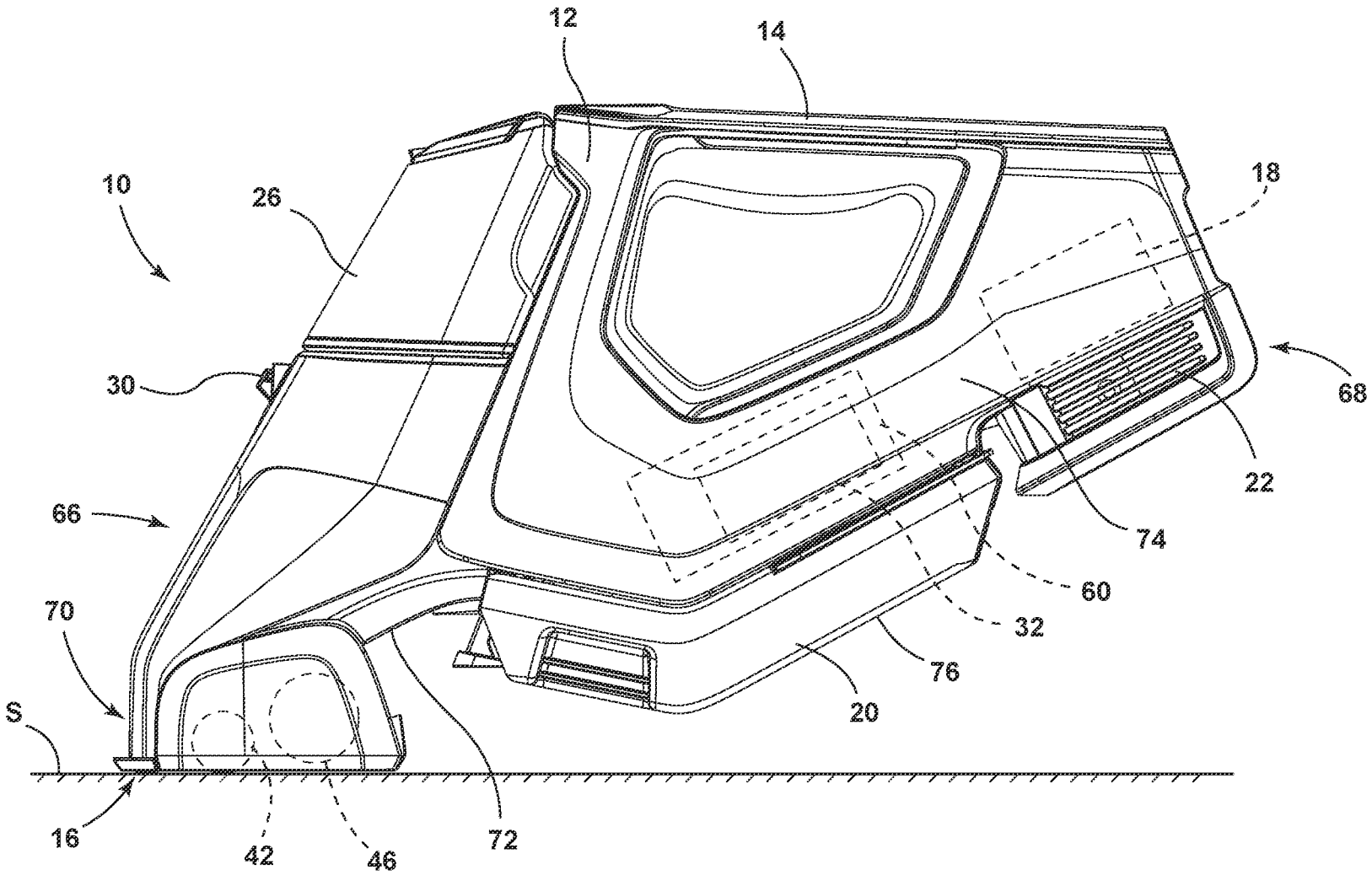
FIG. 3 is a side view of the handheld extraction cleaner from FIG. 1 in one example of a normal use position.

FIG. 3 is a side view of the handheld extraction cleaner 10 from FIGS. 1-2, shown in one example of an operative or normal use position relative to a surface S to be cleaned. In the operative or normal use position, the extraction cleaner 10 is held with the suction nozzle 16 generally adjacent the surface to be cleaned. The suction nozzle 16 is provided at a forward end 66 of the housing 12 while the suction source 18, shown in phantom line in FIG. 3, is provided at a rearward end 68 of the housing 12. The supply tank 26 can be provided forwardly of the suction source 18, and above the suction nozzle 16. The recovery tank 20 can be provided on the housing 12 below the supply tank 26 and suction source 18, and can be longitudinally disposed between the supply tank 26 and the suction source 18. The carry handle 14 is disposed above the recovery tank 20, and extends behind the supply tank 26 in the longitudinal direction. The carry handle includes a hand grip portion and a finger receiving area, which can be a closed volume, e.g. a closed loop handgrip. The brushroll 42 and brush drive motor 46, shown in phantom line in FIG. 3, are provided at the forward end 66 of the housing 12. The pump 32 and battery pack 60, shown in phantom line in FIG. 3, are provided above the recovery tank 20 and below the carry handle 14. This arrangement of component parts of the extraction cleaner 10 offers a balanced weight in hand for the user, and a comfortable carrying and operational position.

The housing 12 can include a cleaning head 70 and a neck 72 connecting the cleaning head 70 to a rearward body 74 including the carry handle 14. The suction nozzle 16 and brushroll 42 can be provided in the cleaning head 70. The suction source 18, recovery tank 20, and battery pack 60 can be provided in the rearward body 74. As can be seen in FIG. 3, the carry handle 14 is oriented so that cleaning head 70 is flat against the surface S when carry handle 14 is generally parallel to the surface S. The recovery tank 20, and particularly the bottom end 76 of the recovery tank 20, can be angled away from the surface S in this position for maneuverability.

Figure 4:
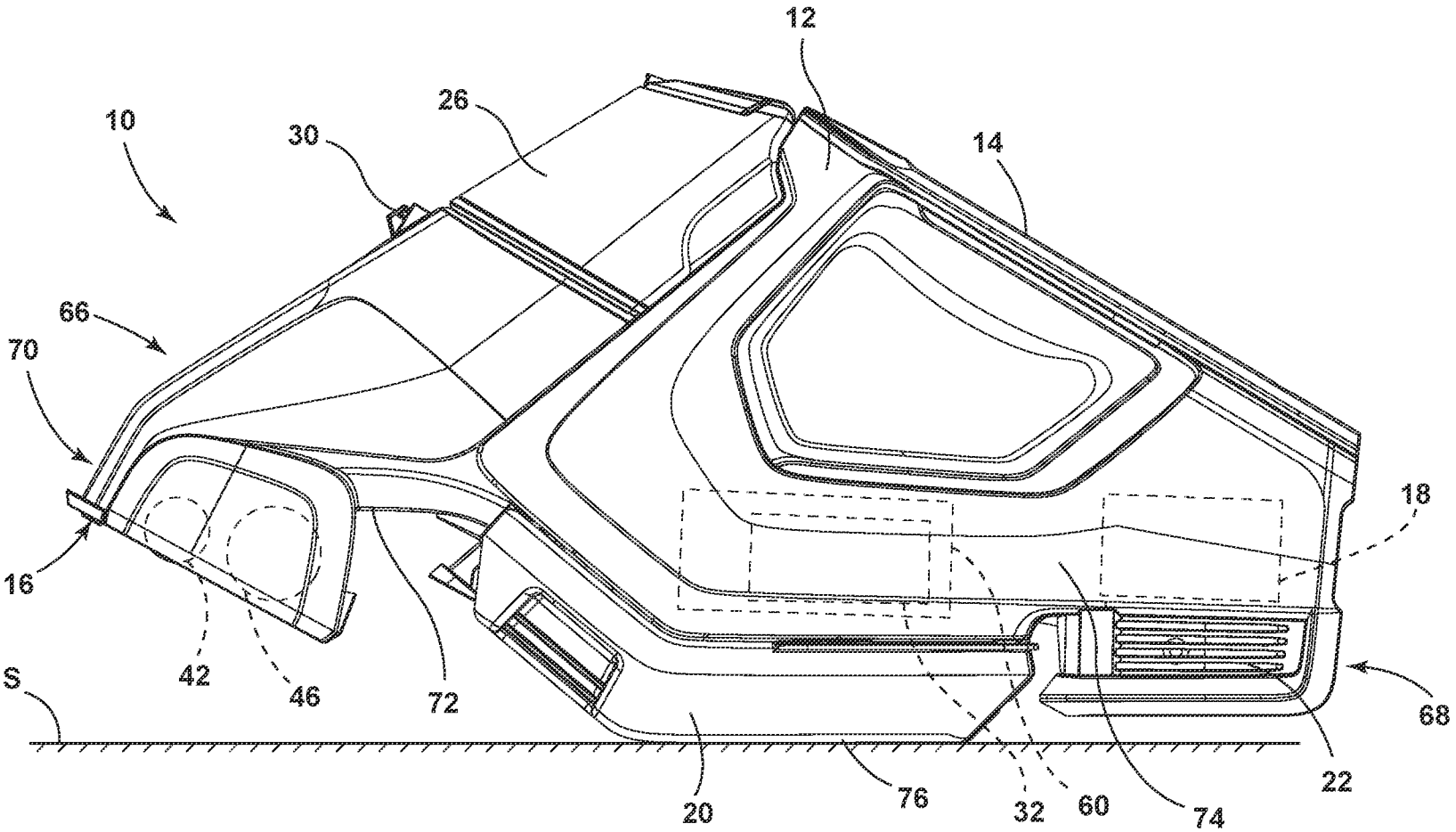
FIG. 4 is a side view of the handheld extraction cleaner from FIG. 1, with the handheld extraction cleaner in a self-standing or at rest position.

The handheld extraction cleaner 10 can be rested in a stable manner on a surface, without leakage from either tank 20, 26. FIG. 4 is a side view of the handheld extraction cleaner 10 showing the handheld extraction cleaner 10 in a self-standing or at rest position on a surface S. As shown, the extraction cleaner 10 can rest on the surface S in a horizontal position, with the handheld extraction cleaner 10 supported on a substantially flat bottom end 76 of the recovery tank 20. The flat bottom end 76 of the recovery tank 20 can lie on the surface S, while the neck 72 of the housing 12 projects forwardly to support the cleaning head 70 away from the surface S. This can be helpful, because a user can set the extraction cleaner 10 down in a stable position, upon a shelf or a countertop, for example, without having the suction nozzle 16 or brushroll 42 in contact with the surface S, and any residual fluid or dirt on the brushroll 42 will not transfer to the surface S. Heavy components (relative to the weight of other components of the cleaner 10) such as the suction source 18 and battery pack 60 are disposed in the rearward body 74, which increases stability in the horizontal position.

Returning to FIG. 2, the suction nozzle 16 can include a front wall 80 and a rear wall 82 defining a narrow suction pathway 84 therebetween, with an opening forming a suction nozzle inlet 86 at a lower end thereof. The suction pathway 84 is in fluid communication with the separator 24 leading to the recovery tank 20.

The front wall 80 can optionally be formed by a nozzle cover 88 that is removable from the housing 12 for cleaning clogs and the like in the suction pathway 84. The rear wall 82 can optionally define a portion of the brush chamber 44, and can be disposed forwardly of the brushroll 42. Alternatively, the front and rear walls 80, 82 can be fixedly attached together in a non-separable configuration. For example, the front and rear walls 80, 82 can be welded together.

The fluid distributor 30 can include at least one distributor outlet 90 for delivering fluid to the surface to be cleaned. The outlet 90 can be positioned to deliver fluid directly to the surface to be cleaned, outwardly in front of the suction nozzle 16 so that user can clearly see where fluid is being applied. Alternately, the outlet 90 can deliver fluid onto the brushroll 42 within the brush chamber 44, rearwardly of the suction nozzle 16. Alternatively, the outlet 90 can deliver fluid behind the suction nozzle 16 and brush chamber 44. The outlet 44 can comprise any structure, such as a nozzle or spray tip. Multiple outlets can also be provided in other embodiments of the extraction cleaner 10. As illustrated in FIG. 2, the distributor 30 can comprise one spray tip provided on the front of the suction nozzle 16 which distributes cleaning fluid to the surface to be cleaned in front of the suction nozzle 16 from the distributor outlet 90.

Figure 5:
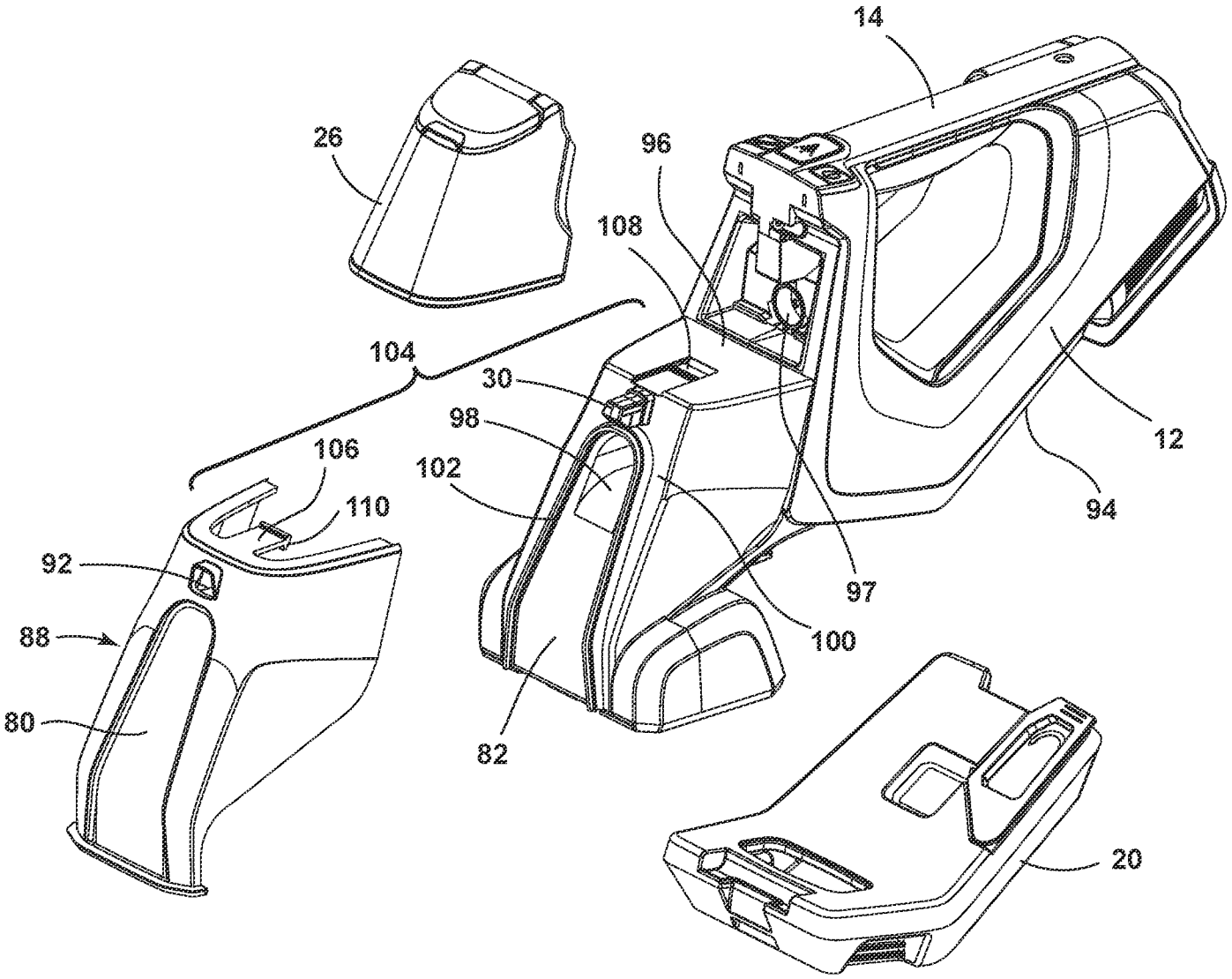
FIG. 5 is a partially-exploded view of the handheld extraction cleaner from FIG. 1.
Figure 6:
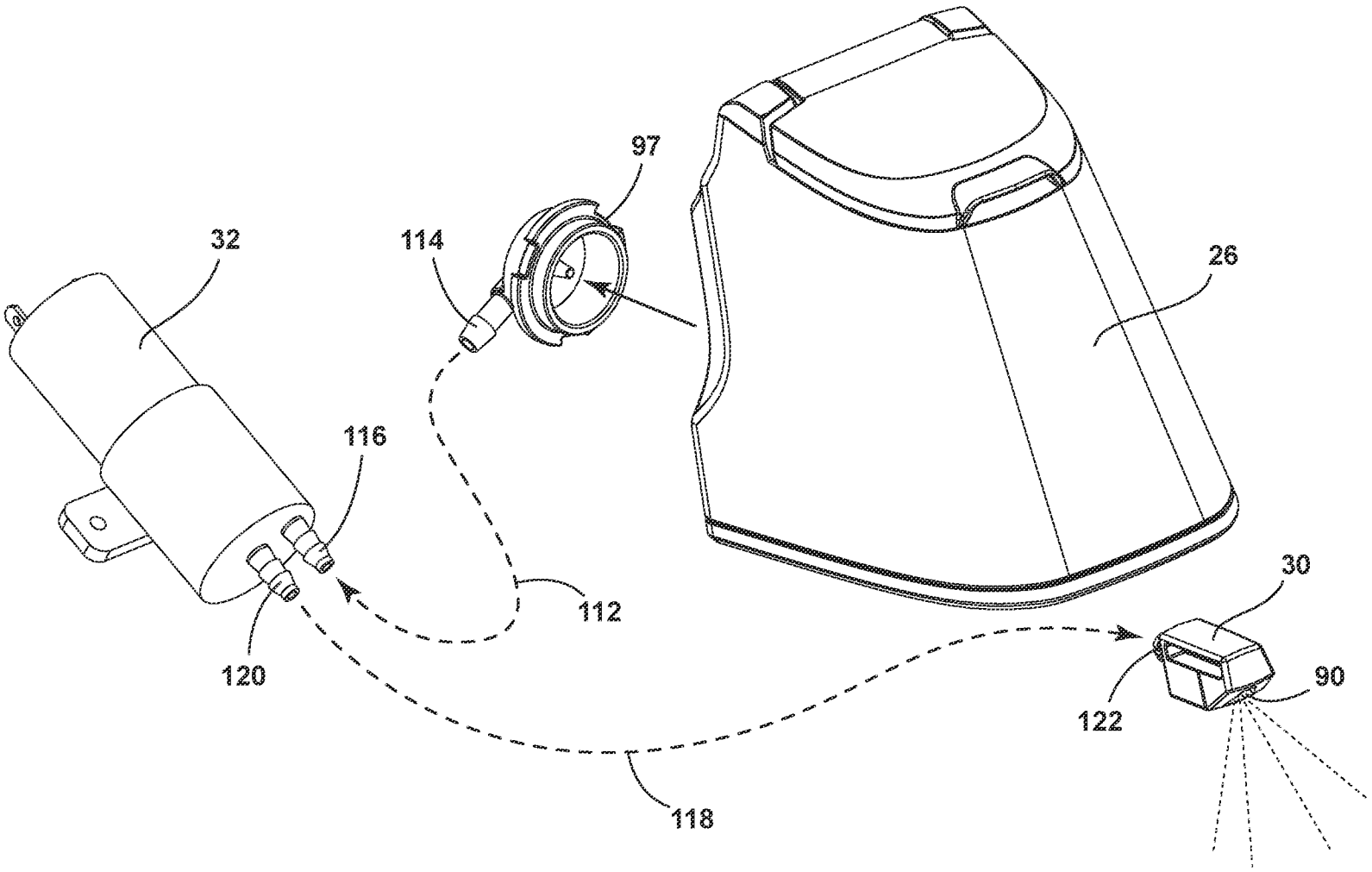
FIG. 6 is a schematic view of a fluid delivery system of the handheld extraction cleaner from FIG. 1, the fluid delivery system including a supply tank.

FIG. 5 is a partially-exploded view of the handheld extraction cleaner 10 from FIG. 1, illustrating the removal of the recovery tank 20, supply tank 26, and nozzle cover 88 from the housing 12. The recovery tank 20 can be removably mounted in a recovery tank receiver 94 formed on a lower side of the housing 12. The supply tank 26 can be removably mounted in a supply tank receiver 96 formed on an upper side of the housing 12. The supply tank receiver 96 has a tank receiver inlet 97 which couples with the supply tank 26 to place the supply tank 26 in fluid communication with the pump 32 (FIG. 6). Latches or other suitable structures can be provided on the housing 12 to secure the tanks 20, 26 within their respective receivers 94, 96. Other mounting arrangements for the tanks 20, 22 are possible, including mounting arrangements where one or both of the tanks 20, 22 are fixedly attached to the housing 12 in a non-separable configuration.

An opening 98 from the suction pathway 84 to the separator 24 can be formed in the rear wall 82 of the suction nozzle 16 defining the suction pathway 84. The nozzle cover 88 can be removably mounted over a forward end 100 of the housing 12 to enclose the opening 98 to the separator 24. Optionally, in addition to the front and rear walls 80, 82 the suction pathway 84 can further by at least one peripheral wall 102 extending between the front and rear walls 80, 82 and around one or more of the sides and top of the suction pathway 84. As shown herein, the peripheral wall 102 can comprise a rib extending from the rear wall 82 and mating with the nozzle cover 88 when the nozzle cover 88 is mounted on the forward end 100 of the housing 12

At least a portion of the fluid distributor 30 can extend through an opening 92 in the nozzle cover 88 to position the distributor outlet 90 on the exterior of the nozzle cover 88. The opening 92 receives and holds the fluid distributor 30 when the cover 88 is mounted on the housing 12. When the user removes the nozzle cover 88 from the housing 12, the fluid distributor 30 remains on the housing 12.

The extraction cleaner 10 can include a retainer 104 to removably secure the nozzle cover 88 on the housing 12. In the illustrated embodiment, the retainer 104 includes a flexible latch 106 on the nozzle cover 88 and a latch receiver 108 on the housing 12. To mount the nozzle cover 88 to the housing 12, the nozzle cover 88 can be hooked onto the forward end 100 of the housing 12 at a lower end thereof via a hook (not shown) and pivoted until the latch 106 snap-fits into the latch receiver 108. The supply tank 26 can rest on top of the nozzle cover 88 when mounted in the supply tank receiver 96, further securing the nozzle cover 88 in place. To remove the nozzle cover 88, a user can lift up on a lip 110 of the latch 106 to free the latch 106 from the latch receiver 108 and pull the cover 88 off the housing 12. With the embodiment of the extraction cleaner 10 shown herein, the supply tank 26 must be removed prior to removal of the nozzle cover 88. In other embodiments, the nozzle cover 88 may be removable without first removing the supply tank 26.

FIG. 6 is a schematic view of the fluid delivery system of the handheld extraction cleaner 10. As discussed above, the fluid delivery system illustrated herein includes the supply tank 26, the pump 32, the fluid distributor 30, and optionally additional conduits, ducts, tubing, hoses, connectors, etc. fluidly coupling the components of the fluid delivery system together and providing a supply path from the tank 26 to the fluid distributor 30. For example, a first conduit 112 can connect an outlet 114 of the receiver 97 with an inlet 116 of the pump 32 and a second conduit 118 can connect an outlet 120 of the pump 32 with an inlet 122 of the fluid distributor 30, which is in fluid communication with the outlet 90. The conduits 112, 118 are indicated in phantom line in FIG. 6, but it is understood that any of the conduits can comprise flexible tubing or molded rigid conduits.

The pump power input control 54 can be provided to power the pump 32 and dispense fluid to the distributor 30. In one example, the pump 32 can be a centrifugal pump. In another example, the pump 32 can be a diaphragm or membrane pump. In still another example, the pump 32 can be a manually actuated spray pump. In yet another configuration of the fluid delivery system, the pump 32 can be eliminated and the flow control system 28 can comprise a gravity-feed system having a valve fluidly coupled with an outlet of the supply tank 26, whereby when valve is open, fluid will flow under the force of gravity to the distributor 30. However, the use of a pump offers the advantage of orienting the supply tank 26 and fluid distributor 30 relative to other components on the body 12 to provide a more balanced weight in hand as well as providing more consistent fluid flow rate compared to a gravity fed system.

Figure 7:
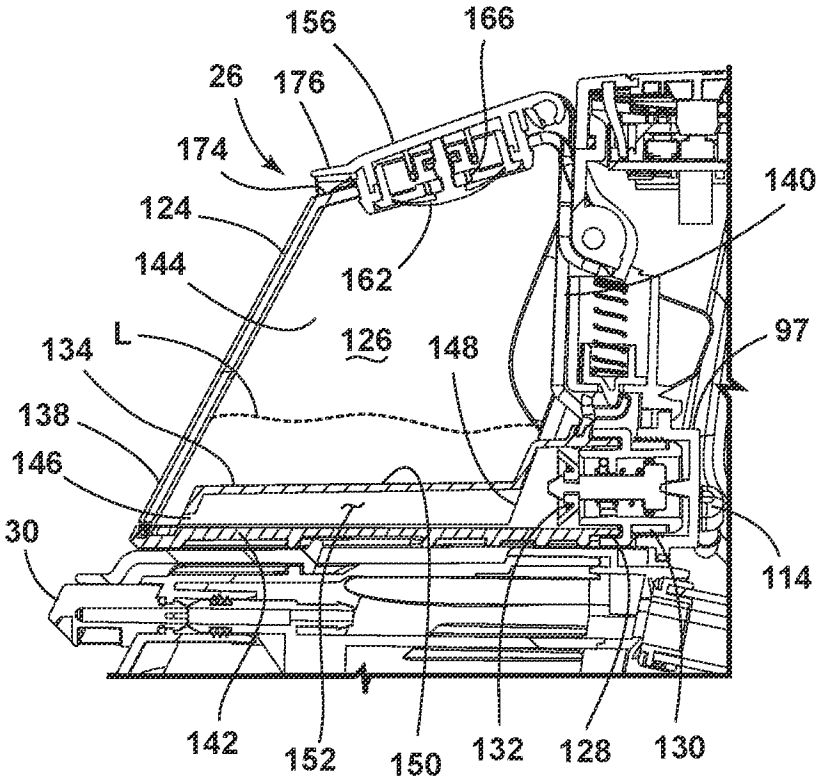
FIG. 7 is a close-up sectional view of the handheld extraction cleaner from FIG. 1, showing an exemplary liquid level in the supply tank in an operative or normal use position of the extraction cleaner.

FIG. 7 is a close-up sectional view showing the supply tank 26. The supply tank 26 comprises a hollow tank body 124 defining a supply chamber 126 for holding a supply of cleaning liquid, with a tank outlet 128. The tank outlet 128 can comprise a quick connect fitting 130 configured to mate with the tank receiver inlet 97, whereby the tank outlet 128 can be quickly connected and unconnected to the receiver inlet 97 using a single hand. The quick connect fitting 130 can have a check valve 132 that is closed with the quick connect fitting 130 is disconnected from the receiver inlet 97. Via the check valve 132, the cleaning fluid is contained within the supply tank 26 automatically when the supply tank 26 is disconnected from the housing 12, preventing leaks.

Figure 8:
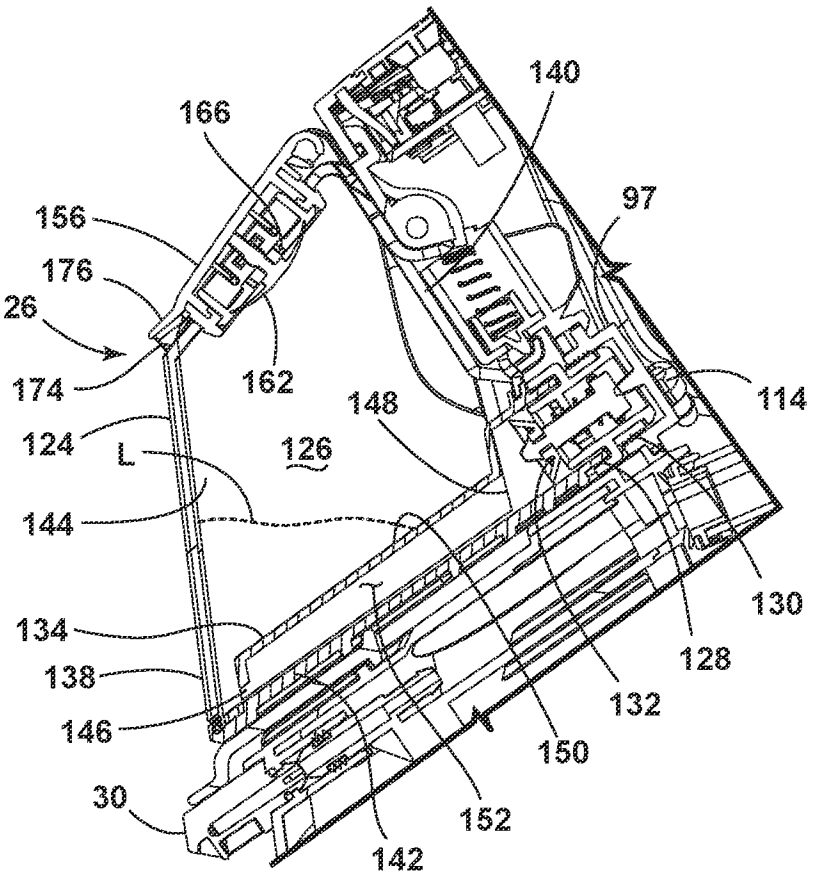
FIG. 8 is a view similar to FIG. 7, showing the liquid level in the supply tank when the extraction cleaner is tipped forward.

FIG. 7 shows an exemplary liquid level, indicated by phantom line L, in the tank 26 in the operative or normal use position of the extraction cleaner 10 (see FIG. 3). FIG. 8 shows the liquid level L when the extraction cleaner 10 is tipped forward. In the tipped position, the liquid moves into a space 136 disposed generally opposite from the tank outlet 128. To prevent the liquid from getting trapped, the supply tank 26 includes a drain pipe 134 so that the pump 32 can suck liquid from the supply tank 26 even when the extraction cleaner 10 is tipped forward. Below a certain level of liquid and at certain degrees of tip, liquid in the tank 26 would not be able to reach the tank outlet 128 without the drain pipe 134.

The quick connect fitting 130 is on one side of the tank body 124 and thus, without the drain pipe 134, a significant portion of liquid gets trapped in the space 136 disposed generally opposite from the quick connect fitting 130 when the tank 26 is tipped as shown in FIG. 8. In the embodiment shown herein, where the quick connect fitting 130 is on the back or rear corner of the tank body 124, the space 136 generally covers a front corner of the tank body 124 opposite the quick connect fitting 130. As shown herein, the tank body 124 includes at least a front wall 138, rear wall 140, bottom wall 142 and side walls 144, and the space 136 can be the space or volume of the supply chamber 126 defined by a lower portion of the front wall 138, forward portion of the bottom wall 142 and lower forward portions of the side walls 144. The quick connect fitting 130 can project outwardly from the rear wall 140.

The drain pipe 134 is disposed at the bottom of the supply chamber 126, and comprises a pipe inlet 146 in fluid communication with the supply tank 126 and a pipe outlet 148 in fluid communication with, or optionally forming, the tank outlet 128. In the embodiment shown herein, liquid is supplied through the pipe outlet 148 to the check valve 132. The drain pipe 134 can be defined by a horizontal baffle 150 separating the supply chamber 126 from a drain pathway 152. Optionally, the drain pipe 134 can be a molded feature integrally formed with the tank body 124 as shown, or a separated pipe inserted into the tank body 124.

Figure 9:
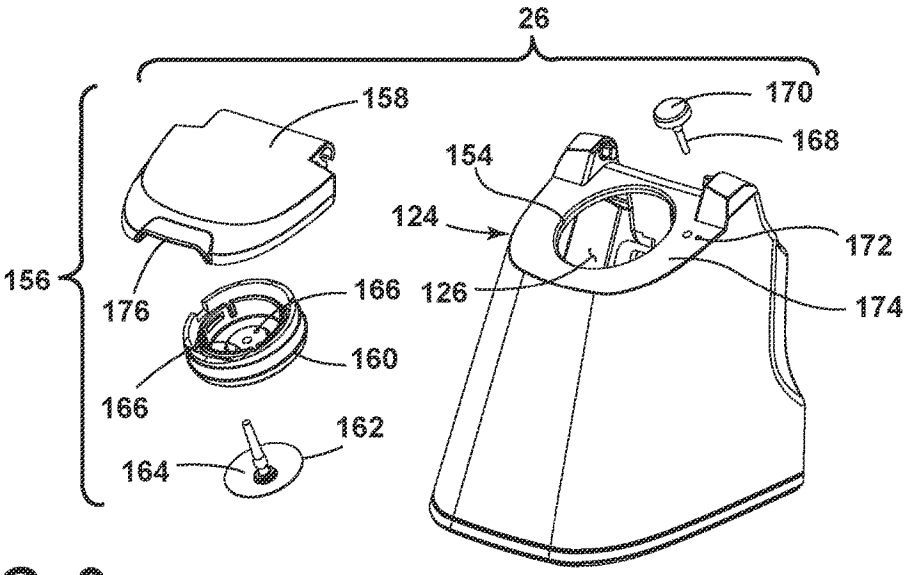
FIG. 9 is an exploded view of the supply tank.

Referring to FIG. 9, the supply tank 26 has a fill opening 154 through which cleaning liquid can be poured into the supply chamber 126 and a fill cap 156 selectively closing the fill opening 154. The fill cap 156 is pivotally coupled to the tank body 124 and can be opened to expose the fill opening 154. The pivotable coupling ensures the fill cap 156 will not completely separate from the tank body 124 during filling. The fill opening 154 can be provided at a side of the tank body 124 that is accessible to a user when the supply tank 26 is mounted on the housing 12, i.e. on a portion of the supply tank 26 that is exterior rather than interior to the extraction cleaner 10 when the supply tank 26 is mounted on the housing 12.

The fill cap 156 can include a cover 158 and a plug 160 on a lower side of the cover 158 which fits into the fill opening 154 when the fill cap 156 is closed. The plug 160 is aligned with the fill opening 154 and sized to seal the fill opening 154 when the fill cap 156 is closed for a fluid-tight closure, such that the supply tank 26 does not leak when the fill cap 156 is closed. The plug 160 can be at least partially received in the fill opening 154 to stop up the fill opening 154 and can comprise a seal made of an elastomeric or other resilient material. Other sealing arrangements are possible, including seals which are not received within the fill opening 154 itself, but which provide a fluid-tight and leak proof engagement between the fill opening 154 and the fill cap 156.

A first check valve 162 is provided on the fill cap 156 to allow ambient air into the supply tank 26 to displace dispensed liquid. The check valve 162 can be, for example, an umbrella valve, having a resilient circular sealing flap 164 for selectively sealing at least one vent hole 166, which can be formed in the plug 160 of the fill cap 156. The sealing flap 164 can lie adjacent to an inner surface of the plug 160 when closed. As liquid is pumped out of the supply tank 26, negative pressure inside the supply tank 26 pulls the sealing flap 164 open, drawing ambient air into the supply chamber 126 via the vent hole(s) 166 to equalize pressure. Once pressure equalizes, the check valve 162 closes.

A second check valve 168 is provided on the tank body 124 for relieving positive pressure or off-gassing caused by some cleaning liquids. With some formulations of cleaning liquids, excess gas is generated inside the supply tank 26 due to reactions between various additives or off-gassing from peroxide formulations, for example. The check valve 168 can be, for example, an umbrella valve, having a resilient circular sealing flap 170 for selectively sealing at least one vent hole 172, which can be formed in a top wall 174 of the tank body 124, which is covered by the fill cap 156 when the fill cap 156 is closed. The sealing flap 170 can lie adjacent to the top wall 174 when closed. As excess gas forms in the supply tank 26, positive pressure inside the supply tank 26 pushes the sealing flap 170 open, thereby venting the excess gas through the vent hole(s) 172 and under the fill cap 156 into the surrounding atmosphere. Once pressure equalizes, the check valve 168 closes.

Figure 11:
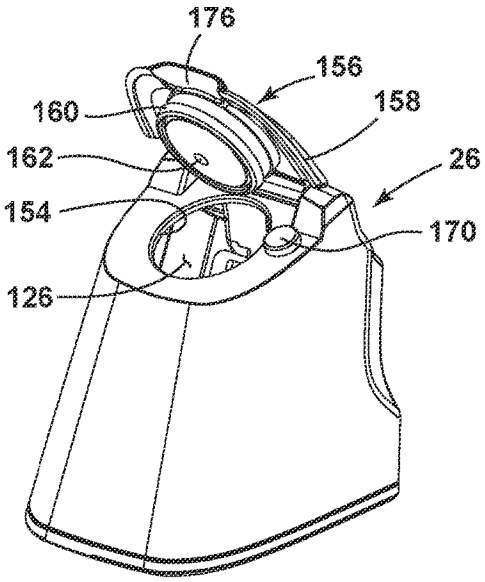
FIG. 11 is a perspective view of the supply tank, showing a fill cap in an open position.
Figure 10:
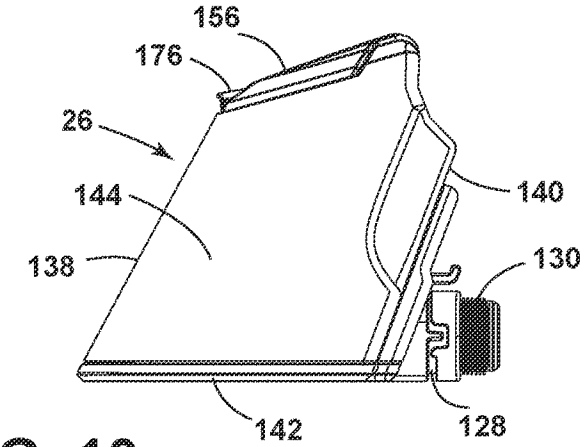
FIG. 10 is a side view of the supply tank.

FIG. 11 is a perspective view showing the fill cap 156 in an open or fill position. The fill cap 156 can be opened by lifting a lip 176 of the fill cap 156 that can be spaced from the top wall 174. When the fill cap 156 is open, liquid from a liquid source, such as a faucet, hose, vessel, etc. can pour into the supply chamber 126. Because the supply tank 26 can be refilled whether it is removed from or still connected with the housing 12, the supply tank 26 is readily refilled. In the illustrated embodiment, the supply tank 26 is removable from the housing 12, and can be refilled when the supply tank 26 is removed from the housing 12 or when the supply tank 26 is still mounted on the housing 12. In another embodiment, the supply tank 26 may not be removable from the housing 12 by the user, and is refilled by carrying the entire extraction cleaner 10 to a faucet or the like.

Figure 12:
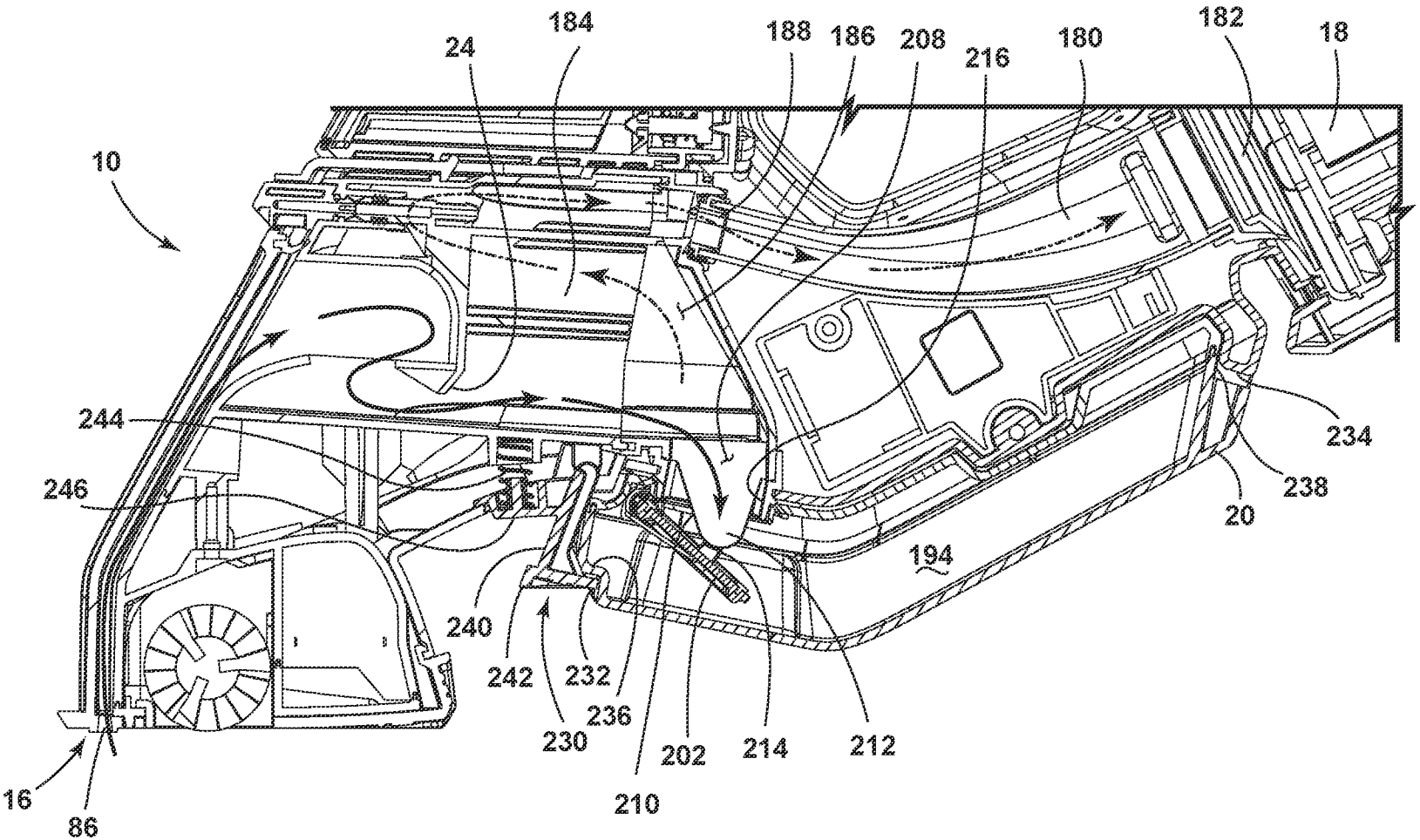
FIG. 12 is a sectional view showing a recovery system of the handheld extraction cleaner from FIG. 1, the recovery system including a recovery tank.

FIG. 12 is a sectional view showing the recovery system of the handheld extraction cleaner 10. As discussed above, the recovery system illustrated herein includes the suction nozzle 16, the separator 24, the recovery tank 20, the suction source 18, the exhaust vents 22 (FIG. 3), and optionally additional conduits, ducts, tubing, hoses, connectors, etc.

fluidly coupling the components of the recovery system together and providing a recovery path from the nozzle inlet 86 to the exhaust vents 22. For example, working air separated from liquid and debris by the separator 24 can travel through a diffuser conduit 180 before reaching an inlet 182 of the suction source 18. The diffuser conduit 180 has a gradually-increasing cross-sectional area to decrease the speed of the working air and increase its pressure. The diffuser conduit 180 can pass underneath the carry handle 14. Optionally, a tortuous conduit 184 can connect an air outlet 186 of the separator 24 with an inlet 188 of the diffuser conduit 180 to improve air/liquid separation and reduce noise.

Figure 13:
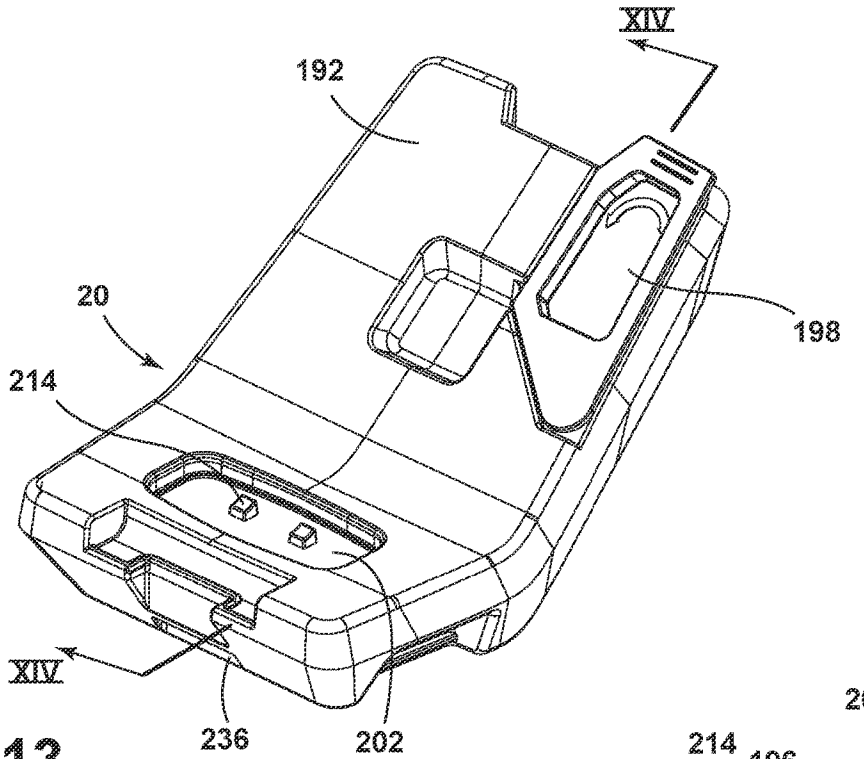
FIG. 13 is a perspective view of the recovery tank.
Figure 14:
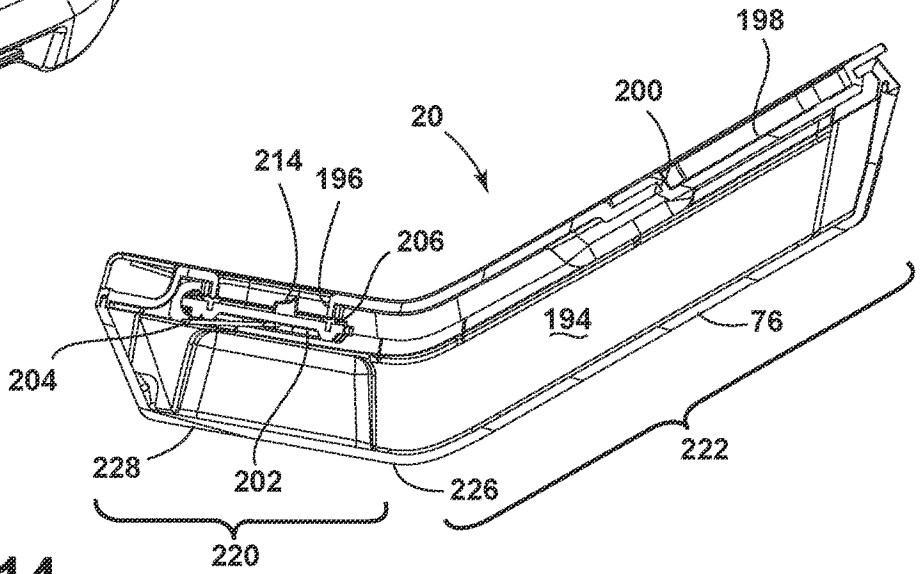
FIG. 14 is a cross-sectional view of the recovery tank taken through line XIV-XIV of FIG. 13.

Referring to FIGS. 13-14, the recovery tank 20 comprises a hollow tank body 192 defining a collection chamber 194 for holding a recovered liquid and debris, with an inlet opening 196 that is in fluid communication with the separator 24 (FIG. 12). A removable tank cap 198 can be provided in an outlet opening 200 formed in the tank body 192 for emptying any liquid or debris in the recovery tank 20 that may be collected in the collection chamber 194.

The recovery tank 20 can include a flapper door 202 that seals the inlet opening 196 when the recovery tank 20 is removed from the housing 12. The flapper door 202 normally closes the inlet opening 196, as shown in FIG. 14, and can pivot between the closed position shown in FIG. 14 and an open position shown in FIGS. 15-16. A torsion spring 204 or other suitable biasing means can bias the flapper door 202 toward the closed position. When removed from the housing 12, the spring-loaded flapper door 202 automatically seals the inlet opening 196. Optionally, a seal 206 can be provided on the flapper door 202 for sealing the interface between the flapper door 202 and the recovery tank inlet opening 196 when the flapper door 202 is closed.

Referring to FIG. 12, the separator 24 includes a debris outlet 208 for transferring debris and liquid separated from the working airstream into the recovery tank 20. A flapper actuator 210 can be provided adjacent the debris outlet 208 in order to automatically open the flapper door 202 when the recovery tank 20 is mounted on the housing 12. In one embodiment of the invention, the actuator 210 can comprise at least one rib 212 which pushes the flapper door 202 open, or away from the tank inlet opening 196, for example to the open position shown in FIG. 12. The rib 212 can extend longitudinally across the debris outlet 208 and project downwardly. The flapper door 202 can include at least one projection 214 which is engaged by the actuator 210. In the embodiment shown, the flapper door 202 includes a pair of projections 214 and the actuator 210 includes a pair of ribs 212, although only one is shown in FIG. 12. Other configurations for the flapper 202 and flapper actuator 210 are possible.

The projections 214 and ribs 212 can have complementary rounded profiles, which help to prevent scratching. The projections 214 also allow the ribs 212 to be shorter and less likely to be damaged while the recovery tank 20 is disassembled from the housing 12.

When the recovery tank 20 is mounted on the housing 12, the ribs 212 push open the flapper door 202. Debris and liquid separated from the working airstream by the separator 24 can enter the recovery tank 20 via the aligned separator debris outlet 208 and recovery tank inlet opening 196. Optionally, a seal 216 can be provided around the separator debris outlet 208 for preventing debris, liquid and air leaks between the separator debris outlet 208 and the recovery tank inlet opening 196. The working airflow from the separator 24 passes through the air outlet 186 to the tortuous conduit 184 and diffuser conduit 180 connecting the separator 24 with the suction source 18.

Figure 15:
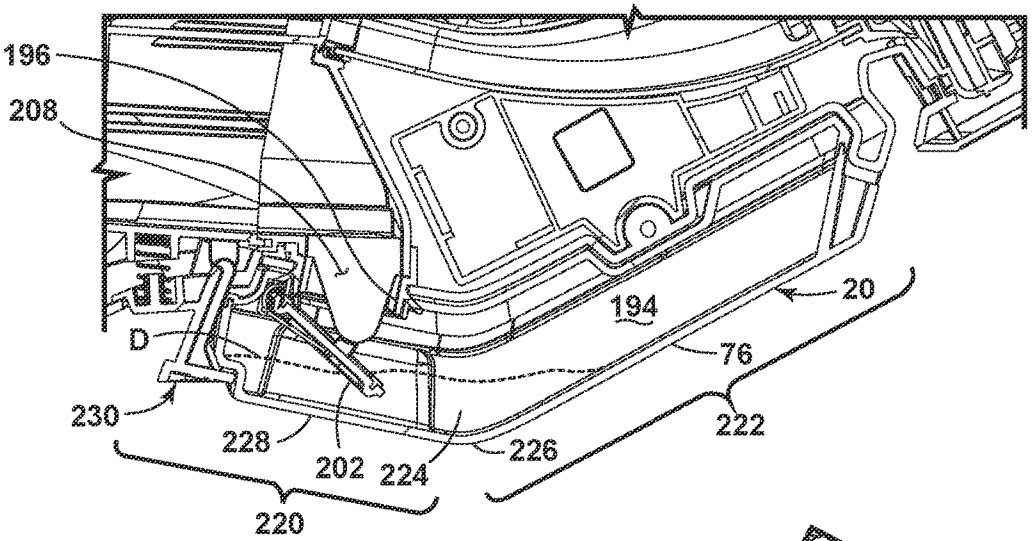
FIG. 15 is a close-up sectional view of the handheld extraction cleaner from FIG. 1, showing an exemplary liquid level in the recovery tank in an operative or normal use position of the extraction cleaner.
Figure 16:
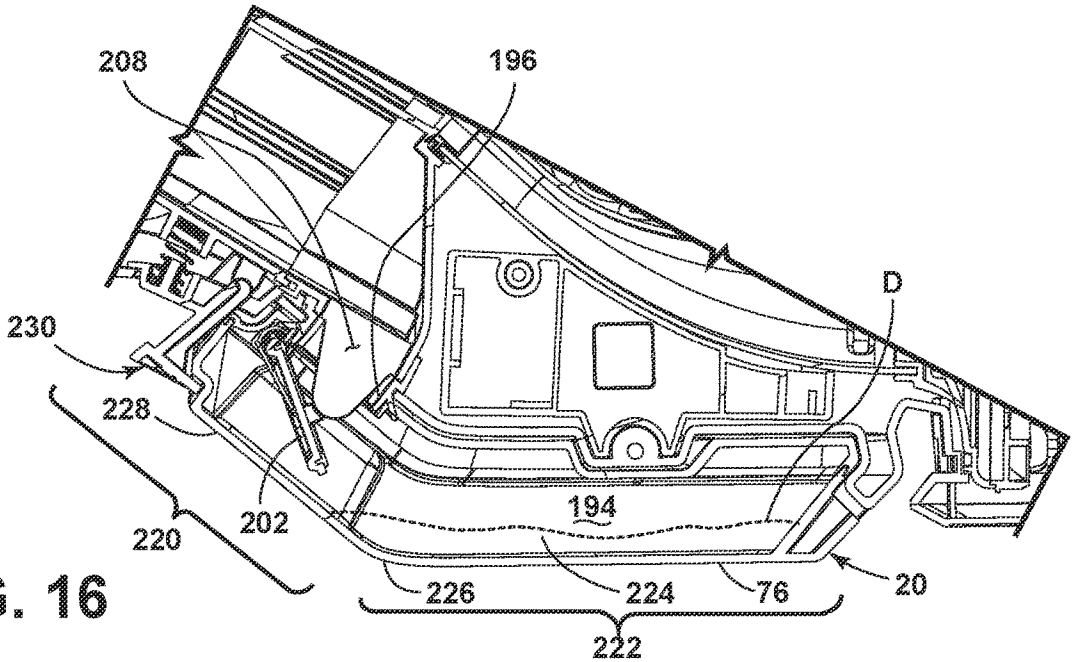
FIG. 16 is a view similar to FIG. 15, showing the liquid level in the recovery tank when the extraction cleaner is in a self-standing or at rest position.

In some embodiments, the recovery tank 20 has an anti-spill shape which directs dirty liquid away from the inlet opening 196 when the extraction cleaner 10 is at rest, such as in the self-standing horizontal position shown in FIG. 4, reducing the change for spillage. FIG. 15 shows an exemplary dirty liquid level, indicated by phantom line D, in the tank 20 in the operative or normal use position of the extraction cleaner 1. FIG. 16 shows the liquid level D when the extraction cleaner 10 is at rest in the self-standing horizontal position. In the rest position, the liquid moves away from the tank inlet opening 196.

The recovery tank 20 shown is approximately V-shaped in side elevation, and includes a first portion or leg 220 and a second portion or leg 222 that extends non-parallel to the first leg 220. The inlet opening 196 can be provided at an upper end of the first leg 220 and the outlet opening 200 can be provided at an upper end of the second leg 222 (see FIG. 14). In operation, dirty liquid is received through the inlet opening 196 at the first leg 220 of the recovery tank 20 and flows to the lowest point in the collection chamber 194 as shown in FIG. 15, generally indicated at 224. When the extraction cleaner 10 is rested in the horizontal position, as shown in FIG. 16, the lowest point 224 in the collection chamber 194 shifts due to the changing angle of the recovery tank 20 and the liquid flows toward the second leg 222, away from the inlet opening 196 in the first leg 220. While a V-shaped tank is shown, other anti-spill shapes for the recovery tank 20 are possible, such as an L-shaped recovery tank.

The first and second portions 220, 222 collectively define the collection chamber 194. The volume of the collection chamber 194 defined by the second leg 222 can be greater than the volume of the collection chamber 194 defined by the first leg 220, so that a greater amount of dirty liquid can be accommodated in the second leg 222 when the extraction cleaner 10 is at rest in the horizontal position. In the illustrated embodiment, the second leg 222 can be elongated relative to the first leg 220 to provide the second leg 222 with a greater volume than the first leg 220.

The recovery tank 20 has a V-shaped bottom 226, in side elevation, defined where the flat bottom end 76 on which the extraction cleaner 10 rests on the horizontal position and a sloped front end 228 which meets the bottom end 76. The V-shaped bottom 226 defines the lowest point 224 in the collection chamber 194 in the use position, which provides the recovery tank 20 with a larger usable tank volume than a tank with an entirely flat bottom.

The recovery tank 20 can be removably received in the recovery tank receiver 94 formed on the bottom of the housing 12. A spring-loaded tank release latch 230 can be provided on the bottom of the housing 12 to secure the recovery tank 20 within the receiver 94. Other mounting arrangements for the recovery tank 20 are possible.

Referring to FIG. 12, in one embodiment, the recovery tank 20 can be suspended on an underside of the housing 12, between front and rear hangers 232, 234 of the tank receiver 94. One of the hangers can be carried by the spring-loaded tank release latch 230 to release the tank 20 from the hanger. In the illustrated embodiment, the release latch 230 can be pivotally mounted on the housing 12 and includes a latching end forming the front hanger 232 and which engages a front end 236 of the recovery tank 20. The rear hanger 234 seats a rear end 238 of the tank 20 to support the rearward end of the tank 20 on the housing 12, with the rear hanger 234 blocking dislocation of the tank 20 from the housing 12 and providing a pivot point for rotation of the tank 20 upwardly into latched engagement with the housing 12.

The release latch 230 can include a post 240 pivotally coupled to the housing 12 at an upper end thereof. The front hanger 232 can project from a lower end of the post 240, such that pivoting of the post 240 moves the front hanger 232. A user-engagable end 242 is also provided at the lower end of the post 240 and can positioned within the area of the neck 72 for easy access.

The release latch 230 is biased toward the latching position shown in FIG. 12 by a return spring 244. A spring seat 246 projects from the post 240 in a direction opposite that of the front hanger 232. The force from the return spring 244 on the spring seat 246 biases the lower end of the post 240 rearwardly to bring the front hanger 232 into engagement with the front end 236 of the recovery tank 20.

To mount the recovery tank 20 to the housing 12, the rear end 238 of the tank 20 is placed in the rear hanger 234 and the front portion of the tank 20 is pivoted upwardly about the rear hanger 234 and latched into place, with the front hanger 232 fitting under the front end 236 of the tank 20. To remove the tank 20, a user can pull forwardly on the user-engagable end 242 of the latch 230 to free the front end 236 from the front hanger 232 and pull the tank 20 off the housing 12. Other tank latches are possible. For example, in other embodiments, the recovery tank 20 can be fastened to the housing 12 via an interference detent.

Figure 17:
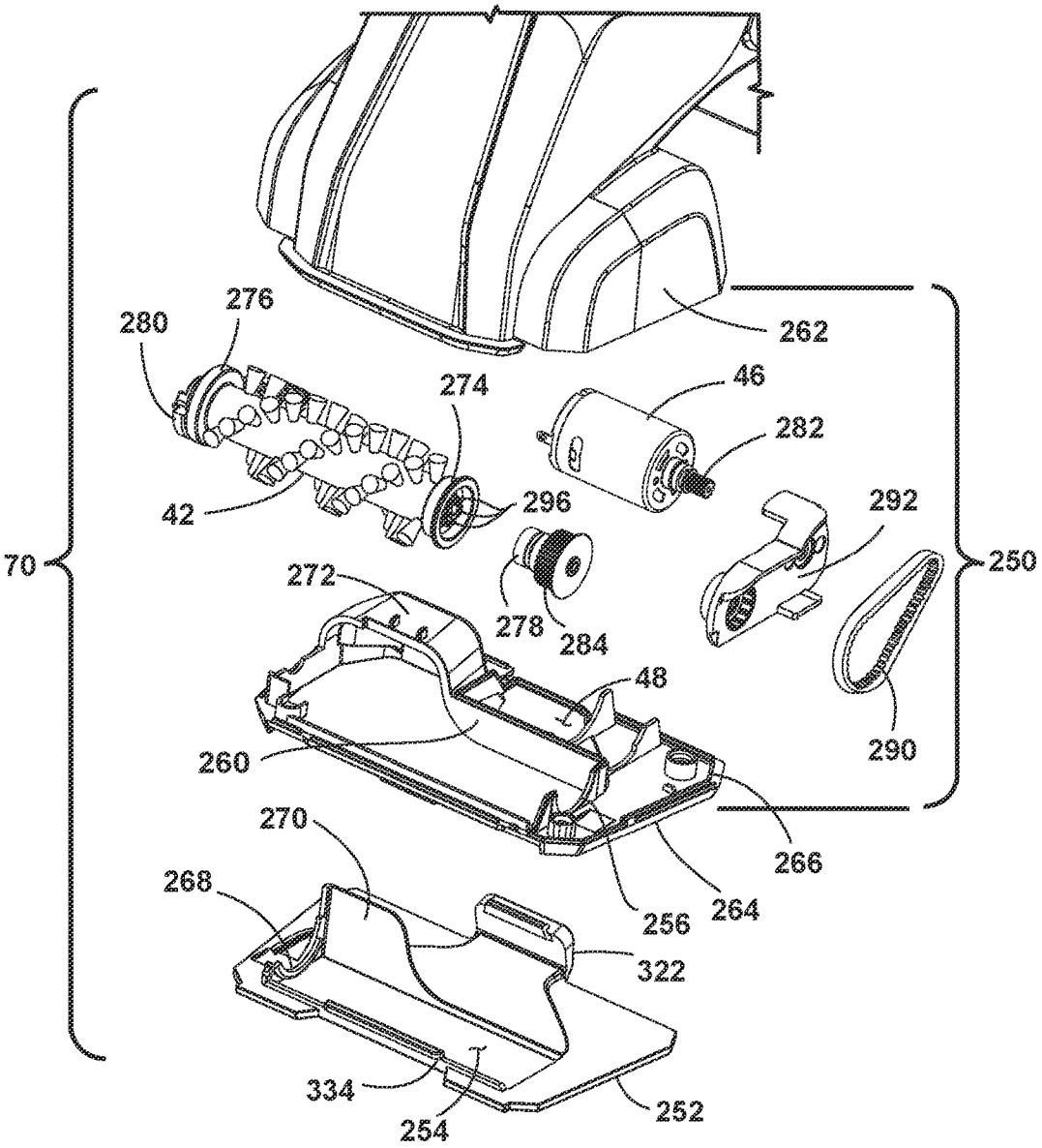
FIG. 17 is a partially-exploded view of a cleaning head of the handheld extraction cleaner from FIG. 1, showing a powered brushroll and a removable sole plate.

Referring to FIG. 17, the brushroll 42 can be removably mounted in the cleaning head 70. In some embodiments, the cleaning head 70 includes a brush housing 250 defining the brush chamber 44 and brush motor chamber 48. A bottom cover or sole plate 252 is mounted beneath the brush housing 250 and secures the brushroll 42 within the brush chamber 44. The sole plate 252 includes an opening 254 through which a portion of the brushroll 42 can project to engage the surface to be cleaned. Removable of the sole plate 252 allows for removal of the brushroll 42, as described in further detail below.

The brush housing 250 can optionally include various molded features, such as a first brushroll cradle 256 for supporting one end of the brushroll 42 within the brush chamber 44, a second brushroll cradle 258 (FIG. 19) for supporting the other end of the brushroll 42 within the brush chamber 44, and a partition 260 separating the brush chamber 44 from the motor chamber 48.

In the embodiment shown herein, the brush housing 250 includes an upper cover 262 and a lower cover 264 which are coupled together to collectively define various features of the cleaning head 70, such as the brush chamber 44, brush motor chamber 48, cradles 256, 258, and partition 260. A gasket 266 can be provide at the interface between the upper and lower covers 262, 264. Other configurations for the brush housing 250 are possible, including brush housings 250 having more than two covers coupled together, or less than two covers coupled together, i.e. a unitary housing.

The sole plate 252 can lie substantially beneath the lower cover 264. Portions of the sole plate 252 may extend above the lower cover 264. Optionally, the sole plate 252 includes various molded features, such as a cradle 268 for supporting an end of the brushroll 42 within the brush chamber 44 and a partition 270 separating the brush chamber 44 from a handle cavity 272 within the brush housing 250, described in further detail below. The handle cavity 272 can optionally be formed as a molded feature on the lower cover 264 as shown in FIG. 17.

Figure 18:
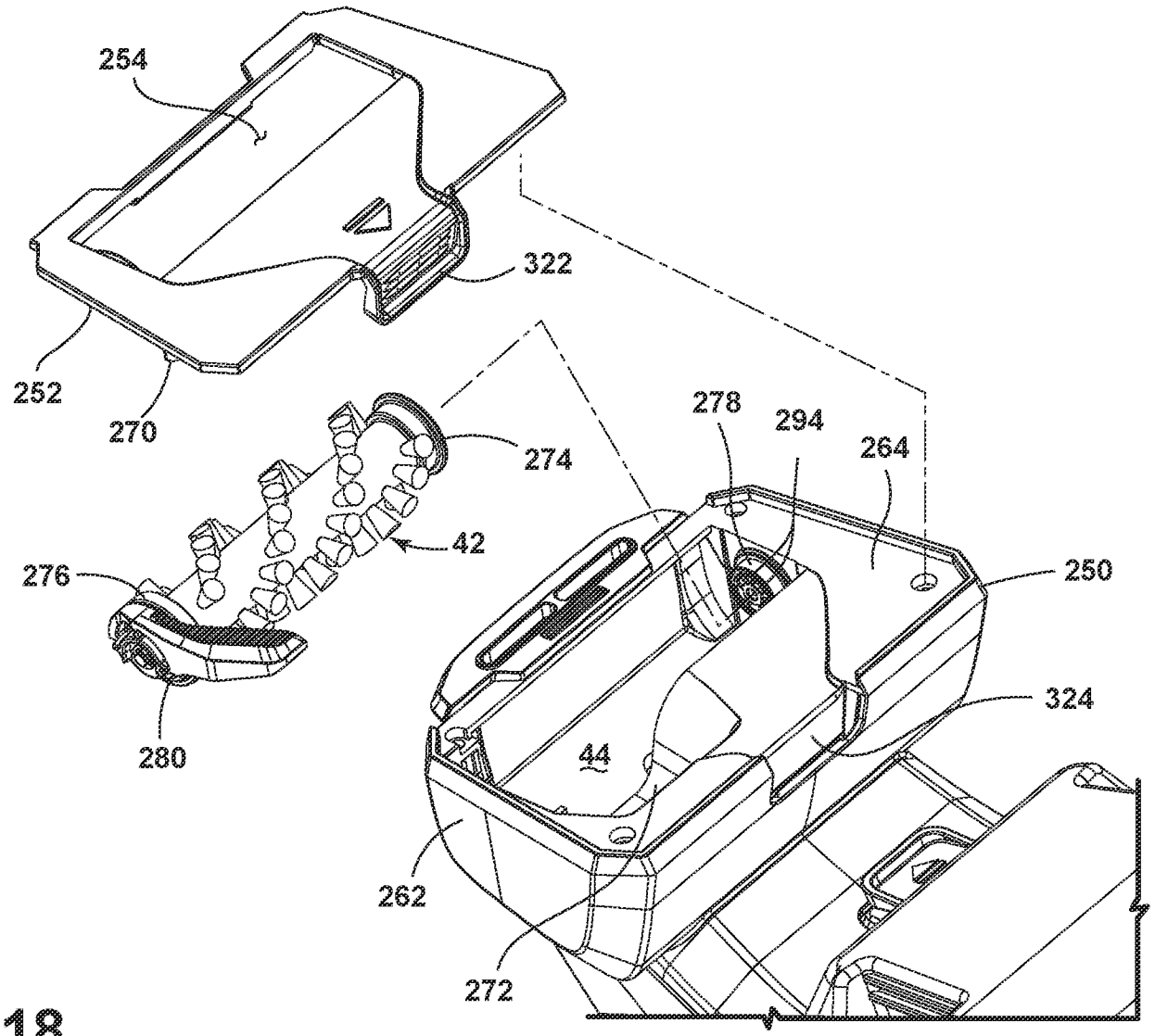
FIG. 18 is a bottom perspective view of the handheld extraction cleaner from FIG. 1, showing the removal of the powered brushroll and sole plate.
Figure 19:
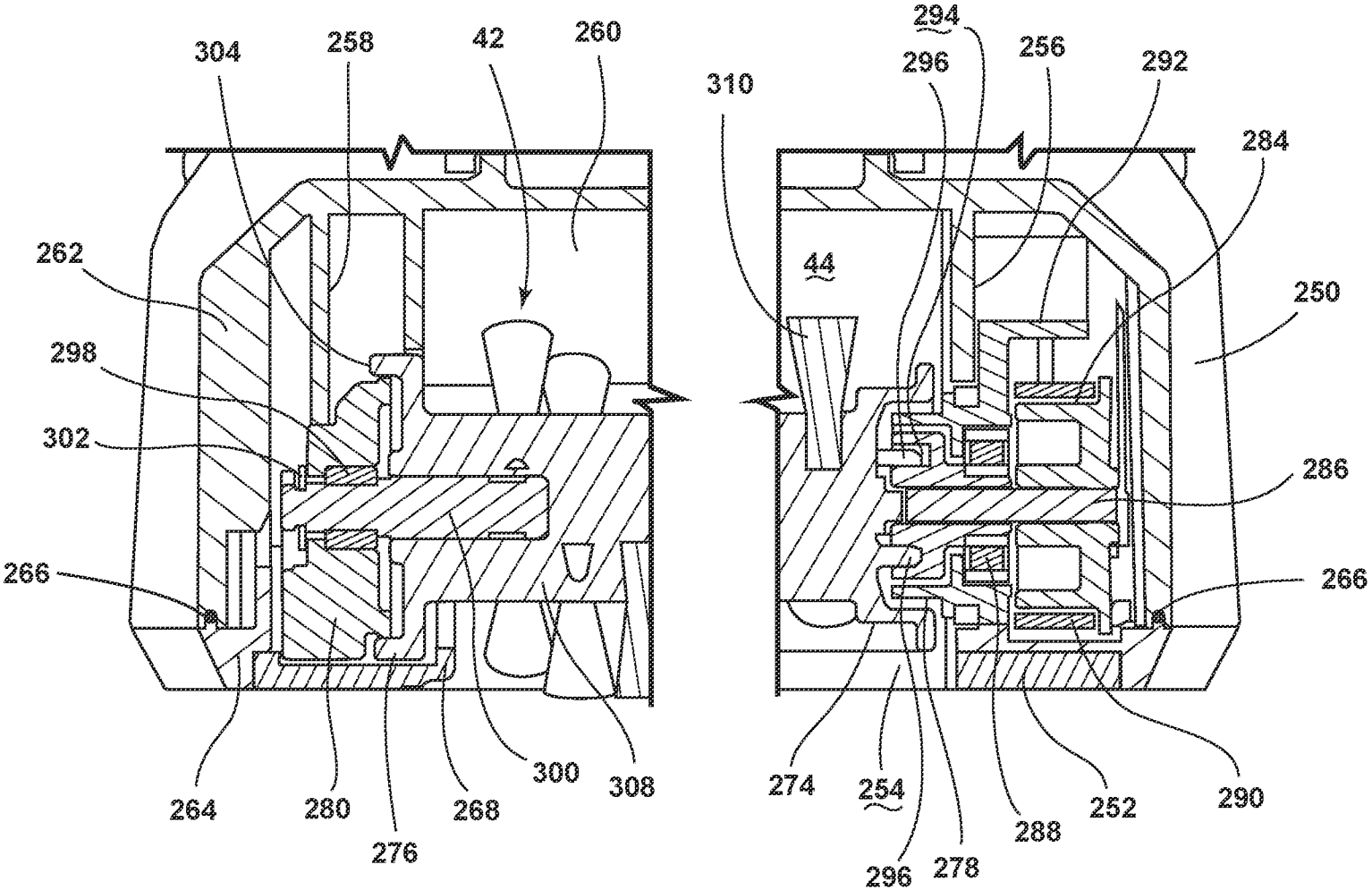
FIG. 19 is a partial sectional view through line XIX-XIX, showing the powered brushroll in the cleaning head, with a portion cutaway for clarity.

In FIGS. 17-19, one embodiment of a drive assembly for the brushroll 42 is shown. As disclosed previously, the brushroll 42 can be operably coupled to and driven by a drive assembly including the brush drive motor 46. The brushroll 42 includes a driven end 274 and a non-driven end 276. The brushroll 42 is mounted at the driven end 274 to a first brush holder 278 and at the non-driven end 276 to a second brush holder 280. The first brush holder 278 transmits torque to the brushroll 42. The second brush holder 280 can be releasably mounted, as described below, so that the brushroll 42 can be easily detached from the first brush holder 278 and removed from the brush chamber 44.

The first brush holder 278 can be held in the first cradle 256 of the brush housing 250, and optionally retained between the upper and lower covers 262, 264 of the brush housing 250. The second brush holder 280 can be releasably held between the second cradle 258 of the brush housing 250 and the cradle 268 of the removable sole plate 252.

The first brush holder 278 is driven by the brush motor 46. A drive gear 282 is fixed with a shaft (not shown) of the brush drive motor 46 and is adapted for cooperative rotation therewith. A driven gear 284 is attached to the first brush holder 278 by a stub shaft 286. The stub shaft 286 is attached to both the driven gear 284 and the first brush holder 278, and is rotatably mounted to the brush housing 250 by a bearing 288.

A drive belt interconnects the drive gear 282 to the driven gear 284. The drive belt 290 is maintained under tension between the gears 282, 284 so that during operation when the brush drive motor 46 is active, rotation of the drive gear 282 induces rotation of the drive belt 290 and, thereby, the driven gear 284 to drive the rotation of the first brush holder 278. The cleaning head 70 can include a belt frame 292 defining a compartment sized to receive the drive belt 290. The belt frame 292 can be disposed at the driven end 274 of the brushroll 42. The belt frame 292 can be attached within the brush housing 250 or can be formed as part of the brush housing 250.

The first brush holder 278 comprises a plurality of holes 294 into which corresponding protrusions 296 on the driven end 274 of the brushroll 42 fit to transmit torque from the first brush holder 278 to the brushroll 42. Alternatively, a splined or keyed connection can be used to transmit torque from the first brush holder 278 to the brushroll 42.

At the non-driven end 276, the brushroll 42 is attached to the second brush holder 280 by a bushing 298. The bushing 298 surrounds a stub shaft 300 mounted in the non-driven end 276 of the brushroll 42. A retaining ring 302 can be mounted on the terminal end of the stub shaft 300 to secure the second brush holder 280 on the stub shaft 300. The non-driven end 276 of the brushroll 42 can optionally include a flange 304 that fits over a peripheral edge of the second brush holder 280 to help isolate the bushing 298 and shaft 300 from dirt.

Figure 20:
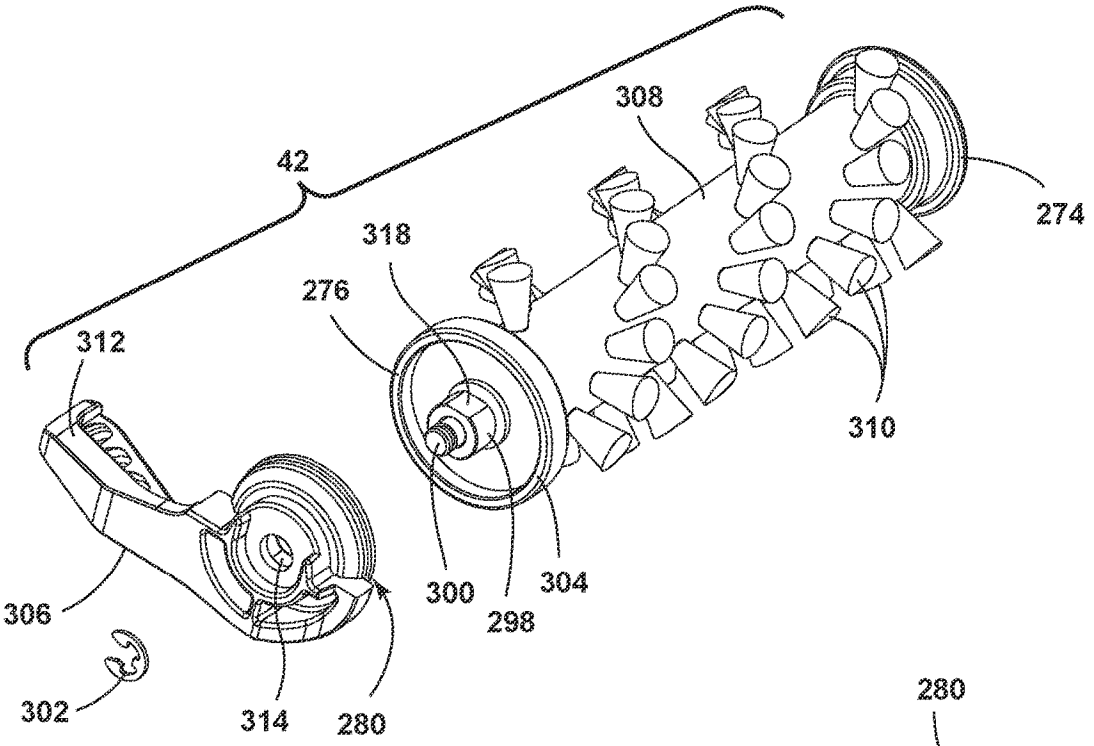
FIG. 20 is an exploded view of the powered brushroll from FIG. 19.

Referring to FIG. 20, one embodiment of the brushroll 42 is shown. As discussed previously the second brush holder 280 can be attached at the non-driven end 276 of brushroll 42 and removably mounted within the brush chamber 44. To facilitate removal of the brushroll 42, a handle 306 can be provided at the non-driven end 276 of brushroll 42. The handle 306 can be coupled with, such as by being integrally formed with or otherwise joined to, the second brush holder 280.

In one embodiment, the brushroll 42 comprises a dowel 308 and a plurality of bristles 310 extending from the dowel 308. The pattern, shape and type of bristles 310 can vary from the pattern, shape, and type shown herein. The bristles 310 may be arranged in a plurality of tufts or in a unitary strip. The dowel 308 can be constructed of a polymeric material such as acrylonitrile butadiene styrene (ABS), polypropylene or styrene, or any other suitable material such as plastic, wood, or metal. The bristles 310 can be constructed of nylon, or any other suitable synthetic or natural fiber. As well, other types of agitation elements are equally usable, such as paddles, flails, wires, elongated teeth or nubs, microfiber material, or a scrubbing material, such as a non-woven or open cell foam scrubbing material.

The handle 306 can comprise a lever arm 312 attached to the brush holder 280. The brush holder 280 can be axially mounted on the brushroll 42, with the brush holder 280 having an aperture 314 for receiving the stub shaft 300. The lever arm 312 can project substantially tangentially from the brush holder 280, thereby projecting tangentially relative to the axis of the brushroll 42. This offsets the lever arm 312 from the axis of the brushroll 42, placing the lever arm 312 closer to the bottom of the brush housing 250 (see FIG. 25). Alternatively, the lever arm 312 can project substantially radially from the brush holder 280.

Figure 21:
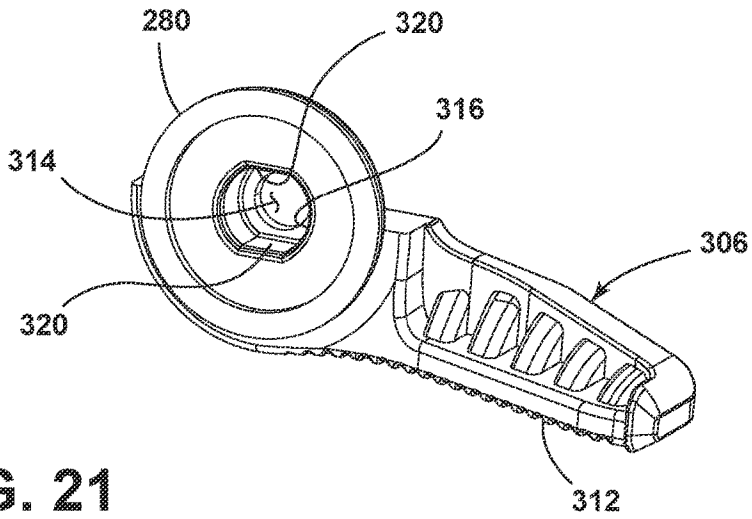
FIG. 21 is a perspective view of a brush holder and handle assembly for the powered brushroll.

Referring additionally to FIG. 21, the bushing 298 fixed on the stub shaft 300 can be press fit into a recess 316 in the brush holder 280 surrounding the aperture 314. With the brush holder 280 attached to the stub shaft 300, the dowel 308 can spin relative to the brush holder 280 during operation, i.e. when the brush motor 46 is active.

Optionally, the brush holder 280 can be keyed with the brushroll 42 to locate maintain alignment between the handle 310 and the brushroll 42 without slipping. In the illustrated embodiment, the bushing 298 is keyed with the recess 316, such as by having flat surfaces 318 which are aligned with flat sides 320 of the recess 316. The keyed coupling ensures that pivoting of the handle 306 can rotate the brush holder 280 relative to the dowel 308, while maintaining axial alignment between the brush holder 280 and the dowel 308.

Figure 22:
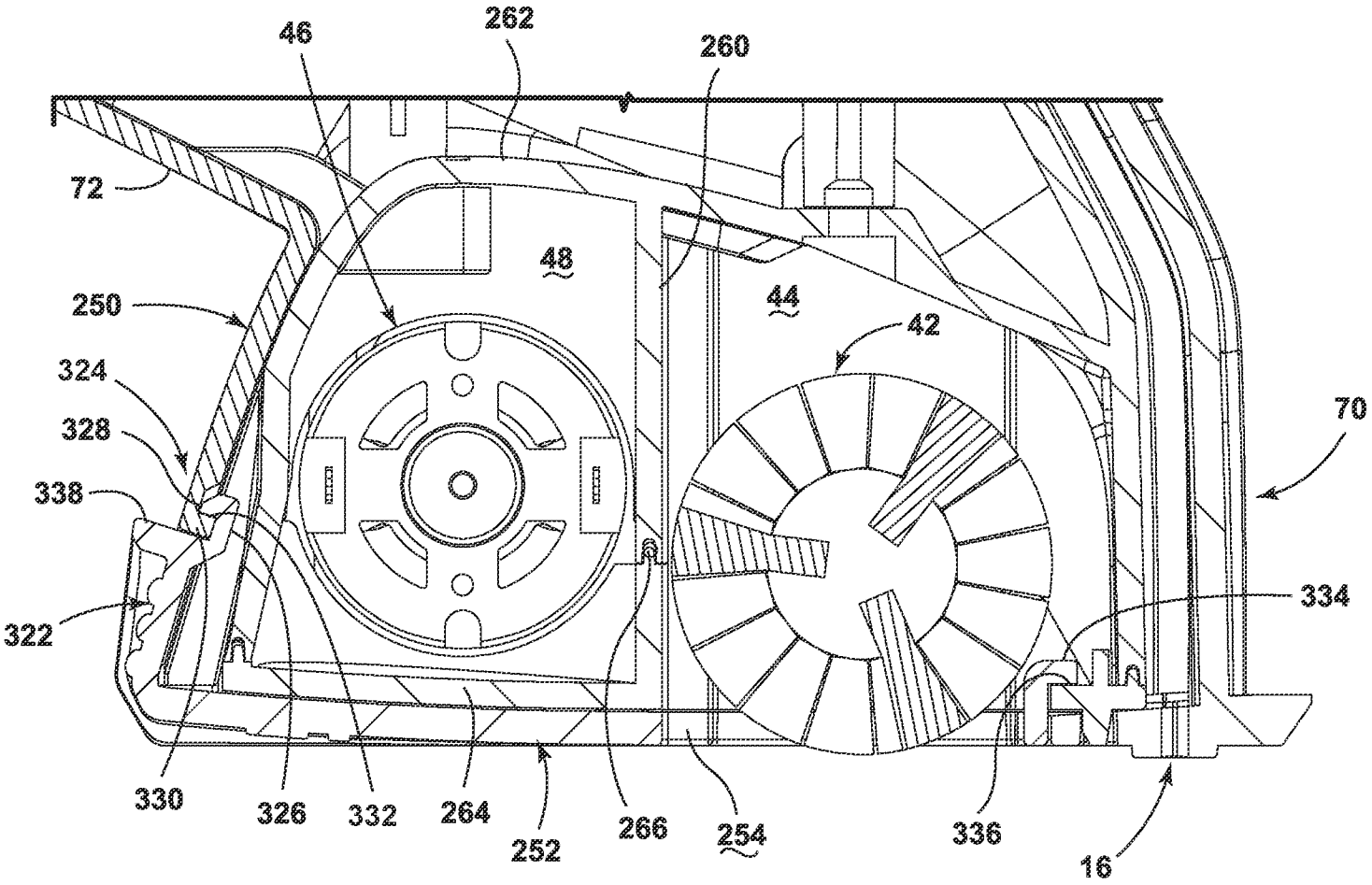
FIG. 22 is a sectional view showing the powered brushroll and brush motor in a cleaning head of the handheld extraction cleaner.

Referring to FIG. 22, the sole plate 252 can be removable from the brush housing 250 for accessing the brushroll 42, and also for cleaning debris and the like in the brush chamber 44. In one embodiment, the sole plate 252 is removable without the use of tools. For example, the extraction cleaner 10 can include a snap-lock retainer to removably secure the sole plate 252 on the brush housing 250 without the user of tools. In the illustrated embodiment, the snap-lock retainer includes a latch 322 on the sole plate 252 and a latch receiver 324 on the brush housing 250. The latch 322 can be provided on a rearward end of the sole plate 252, with the latch receiver 324 on a rearward side of the brush housing 250.

Optionally the latch 322 can include a flexible finger 326 having a hook end 328, and the latch receiver 324 can include a flange 330 forming a shoulder 332. When the sole plate 252 is retained on the brush housing 250, the finger 326 snaps around the flange 330, with the hook end 328 seated on the shoulder 332 to lock the sole plate 252 on the brush housing 250.

A lip 334 on the sole plate 252 seats on an ledge 336 of the brush housing 250 to support the forward end of the sole plate 252 on the brush housing 250, with the ledge 336 blocking dislocation of the sole plate 252 from the brush housing 250 and providing a pivot point for rotation of the sole plate 252 upwardly into latched engagement with the brush housing 250. The lip 334 can project laterally from the opening in the sole plate 252, and the ledge 336 can project in opposition to the lip 334.

To mount the sole plate 252 to the housing 252, the lip 334 is slid onto the ledge 336 of the brush housing 250 and the rear portion of the sole plate 252 is pivoted upwardly about the ledge 336 and snapped into place, with the latch 322 snap-fitting into the latch receiver 324. To remove the sole plate 252, a user can pull downwardly on an edge 338 of the latch 322, which projects outwardly away from the brush housing 250, to free the latch 322 from the latch receiver 324 and pull the sole plate 252 off the brush housing 250. The latch 322 can positioned within the area of the neck 72 for easy access. Other sole plate latches are possible. For example, in other embodiments, the sole plate 252 can be fastened to the brush housing 250 via mechanical fasteners, integrally formed snaps, clips, or a combination thereof.

When the brushroll 42 is installed in brush chamber 44, the second brush holder 280 fits in the cradle 580 formed in the brush housing 250, with the lever arm 312 projecting into the cavity 272. The brushroll 42 is secured in the brush chamber 44 by the attachment of the sole plate 252, with the sole plate cradle 268 pressing the brush holder 280 against the cradle 280 of the brush housing 250.

The handle 306 provides a convenient place to grip the brushroll 42 during removal. Often, users must directly grip a dirty and/or wet brushroll to remove it from a surface cleaning apparatus. The handle 306 can lie within the cavity 272, and be enclosed by the partition 270 on the sole plate 252 to protect the handle 306 from dirt and liquid in the brush chamber 44. The handle 306 is also covered by the sole plate 252 when the sole plate 252 is attached to the brush housing 250. Thus, the handle 306 remains relatively clean and dry.

Figure 25:
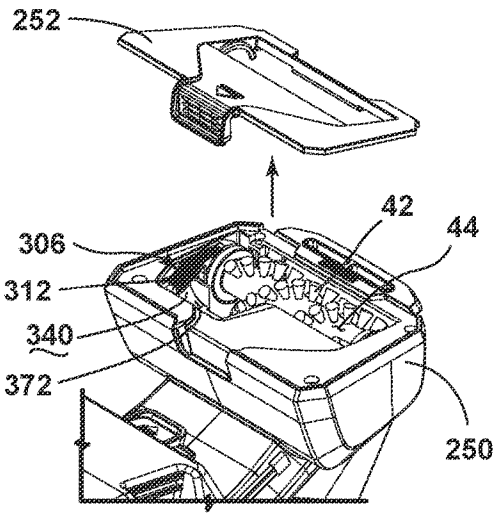
FIGS. 23-27 show illustrate a method of removing the powered brushroll from the handheld extraction cleaner.
Figure 24:
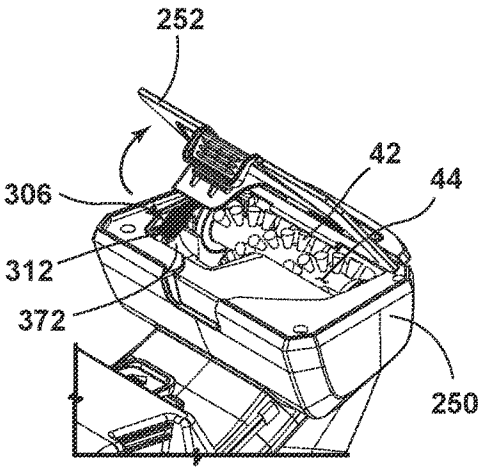
Figure 23:
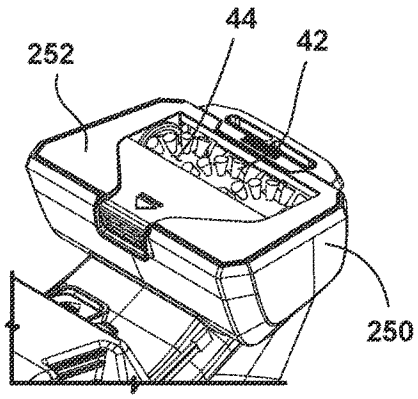
Figure 27:
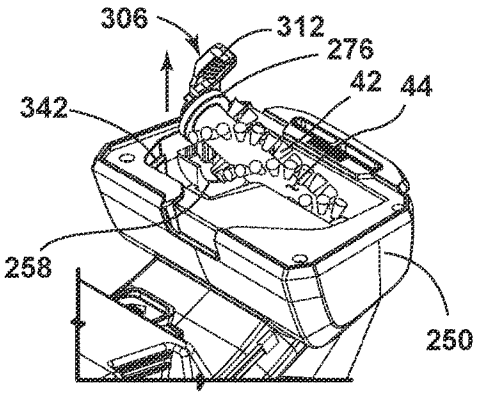

A method of removing the brushroll 42 can include the steps shown in FIGS. 23-27. The specific sequence of steps discussed is for illustrative purposes only and does not limit the method unless otherwise noted, as it is understood that the steps may proceed in a different logical order, additional or intervening steps may be included, or described steps may be divided into multiple steps, without detracting from the invention. In FIG. 23, the sole plate 252 is attached to the brush housing 250. Upon removal of the sole plate 252, as shown in FIGS. 24-25, the handle 306 is exposed. When the lever arm 312 is lifted up, the stub shaft 300 (FIG. 19) will rotate with the brush holder 280, the while the dowel 308 remains stationary, and the user can lift up on the lever arm 312 to pull the brushroll 42 out of the brush chamber 44 as shown in FIG. 27.

Figure 26:
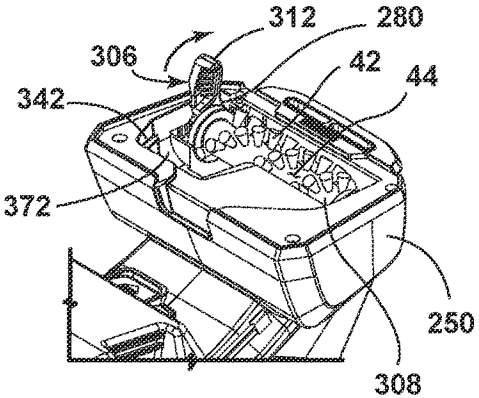

As shown in FIG. 25, when retracted into the brush housing 250, the handle 306 can be spaced from a surface of the cavity 372 by a fixed distance or gap 340 so that a user can reach under the lever arm 312 to pivot the lever arm 312 out of the cavity 272 in the brush housing 250 as shown in FIG. 26. A standoff 342 can be provided in the handle cavity 272 to maintain the gap 340 between the handle 306 and the brush housing 250.

Optionally, the brushroll 42 can be exchanged for another agitator. In some embodiments, multiple agitators can be provided with the handheld extraction cleaner 10, and can be interchangeably mounted to the body 12. Some examples of other agitators are shown in FIGS. 28-31. Each of the agitators can have a handle 306 coupled to a non-driven end of the agitator. Alternatively, one handle 306 can be interchanged among the different agitators.

Figure 28:
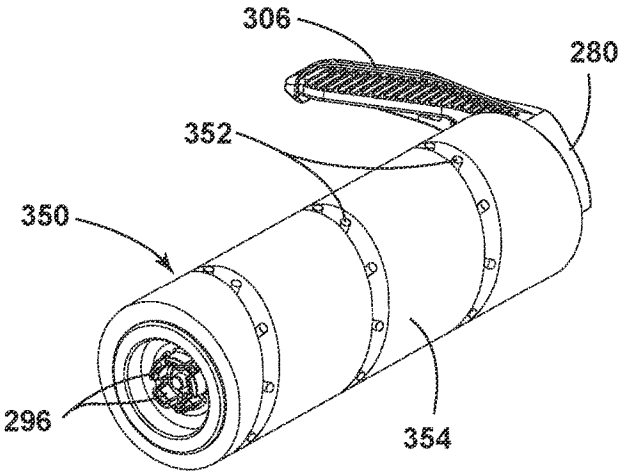
FIG. 28 is a perspective view of a second embodiment of an agitator for the handheld extraction cleaner from FIG. 1.

Referring to FIG. 28, in one embodiment, an agitator for the extraction cleaner 10 is a hybrid brushroll 350 that includes multiple agitation materials to optimize cleaning performance on different types of surfaces to be cleaned, including hard and soft surfaces, and for different cleaning modes, including wet and dry vacuum cleaning. In one embodiment, the brushroll 350 comprises a plurality of bristles 352 and microfiber material 354 arranged between the bristles 352. The microfiber material 354 can be constructed of polyester, polyamides, or a conjugation of materials including polypropylene or any other suitable material known in the art from which to construct microfiber. Embodiments of a suitable hybrid brushroll are disclosed in U.S. Patent Application Publication No. 2018/0110388, which is incorporated herein by reference in its entirety.

Figure 29:
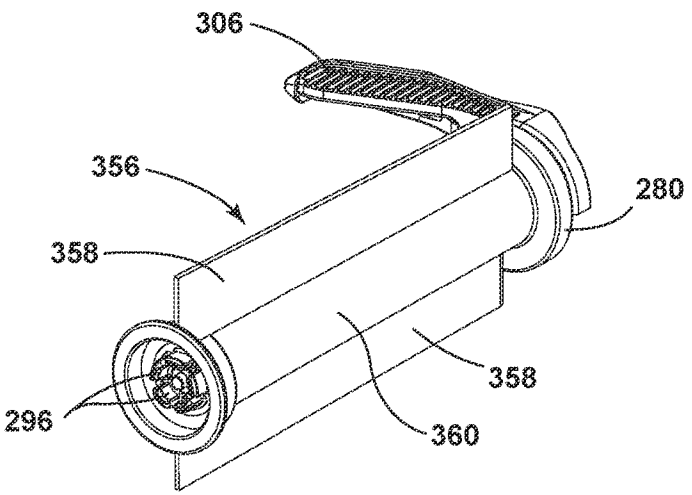
FIG. 29 is a perspective view of a third embodiment of an agitator for the handheld extraction cleaner from FIG. 1.

Referring to FIG. 29 in a further embodiment, an agitator for the extraction cleaner 10 is a brushroll 356 having a plurality of flexible paddles or wipers 358 arranged at an angle to the longitudinal axis of the brushroll 356. In one embodiment, the brushroll 356 comprises a dowel 360, with the paddles or wipers 358 extending radially from the dowel 360. The paddles or wipers 358 can be constructed of an elastomer, such as ethylene propylene diene monomer (EPDM) rubber, thermoplastic elastomer (TPE), or thermoplastic polyurethane (TPU).

Figure 30:
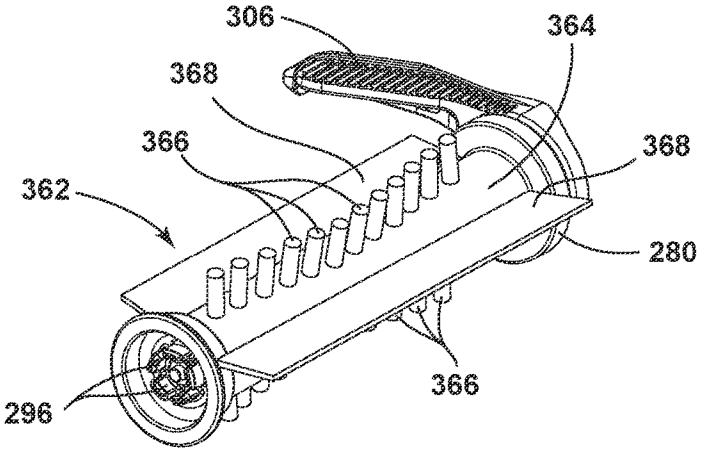
FIG. 30 is a perspective view of a fourth embodiment of an agitator for the handheld extraction cleaner from FIG. 1.

Referring to FIG. 30 in yet another embodiment, an agitator for the extraction cleaner 10 is a brushroll 362 having a dowel 364, a plurality of bristles 366 extending from the dowel 364, and a plurality of paddles or wipers 368 extending from the dowel 364 and arranged between the bristles 366.

Figure 31:
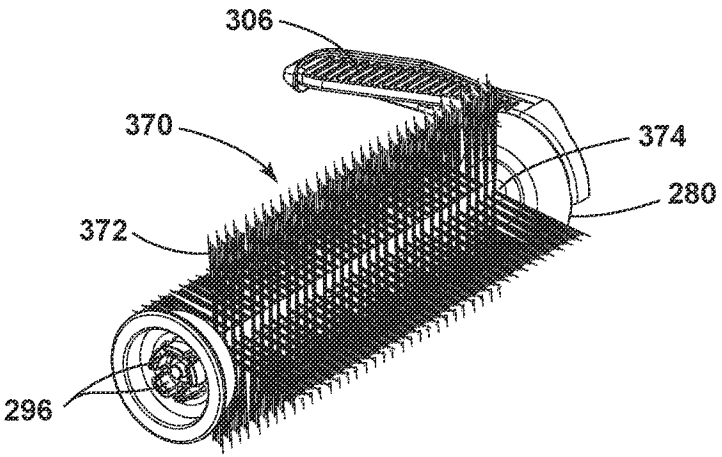
FIG. 31 is a perspective view of a fifth embodiment of an agitator for the handheld extraction cleaner from FIG. 1.

Referring to FIG. 31 in still another embodiment, an agitator for the extraction cleaner 10 is a brushroll 370 in the form of a twist-wire brush having a continuous helix of bristles 372 bound together by a twist-wire spindle 374. Optionally, the twist-wire spindle 374 can be constructed of stainless steel and the bristles 372 can be nylon, or any other suitable synthetic or natural fiber.

The handheld extraction cleaner 10 can be used to effectively remove debris (which may include dirt, dust, soil, hair, and other debris) and fluid from the surface to be cleaned in accordance with the above-described methods. The sequence of steps discussed herein for any method of using the extraction cleaner 10 is for illustrative purposes only and is not meant to limit the method in any way as it is understood that the steps may proceed in a different logical order, additional or intervening steps may be included, or described steps may be divided into multiple steps, without detracting from the invention.

To the extent not already described, the different features and structures of the various embodiments of the invention, may be used in combination with each other as desired, or may be used separately. That one handheld extraction cleaner 10 is illustrated herein as having all of these features does not mean that all of these features must be used in combination, but rather done so here for brevity of description. Furthermore, while the extraction cleaner 10 shown herein is handheld, some features of the invention can be useful on a conventional upright or stick cleaner. Still further, the extraction cleaner 10 can additionally have steam delivery capability. Thus, the various features of the different embodiments may be mixed and matched in various extraction cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A handheld extraction cleaner, comprising:

a unitary body including a carry handle;

a fluid delivery system including a supply tank carried by the unitary body and at least one fluid distributor a recovery system including a working air path through the unitary body, a suction nozzle defining an inlet to the working air path, a suction source in fluid communication with the suction nozzle, and a recovery tank carried by the unitary body, the recovery tank comprising:

a tank body defining a collection chamber for dirty liquid recovered by the recovery system, the tank body having a first portion and a second portion, wherein the first portion of the recovery tank is disposed at an angle relative to the second portion of the recovery tank; and an inlet opening in the first portion of the tank body, the collection chamber configured to receive dirty liquid through the inlet opening;

wherein the second portion of the tank body has a bottom surface configured to rest on a horizontal surface to support the handheld extraction cleaner in a horizontal orientation on the horizontal surface; and wherein the inlet opening is disposed above the second portion of the tank body when the extraction cleaner is at rest in the horizontal orientation on the horizontal surface to direct dirty liquid away from the inlet opening.

2. The handheld extraction cleaner of claim 1, wherein the first portion of the recovery tank is generally oblique to the horizontal surface when the extraction cleaner is at rest in the horizontal orientation on the horizontal surface.

3. The handheld extraction cleaner of claim 1, wherein the recovery tank has a V-shaped bottom, the V-shaped bottom including the bottom surface and a sloped front end which meets the bottom surface.

4. The handheld extraction cleaner of claim 1, wherein the first and second portions of the tank body define the collection chamber, and wherein a volume of the collection chamber defined by the second portion is greater than a volume of the collection chamber defined by the first portion.

5. The handheld extraction cleaner of claim 1, wherein the recovery tank is removably mounted to the unitary body.

6. The handheld extraction cleaner of claim 5, wherein the unitary body comprises a recovery tank receiver formed on a lower side of the unitary body and the recovery tank is removably mounted in the recovery tank receiver.

7. The handheld extraction cleaner of claim 6, comprising:

a spring-loaded tank release latch securing the recovery tank in the recovery tank receiver;

wherein the recovery tank receiver has a front hanger supporting a front end of the recovery tank and a rear hanger supporting a rear end of the recovery tank; and wherein one of the front hanger and the rear hanger is carried by the spring-loaded tank release latch.

8. The handheld extraction cleaner of claim 5, wherein:

the recovery system comprises a separator defining a portion of the working air path through the unitary body, the separator including a debris outlet aligned with the inlet opening to transfer dirty liquid separated from a working airstream into the recovery tank; and the unitary body comprises a portion housing the separator and the separator remains in position when the recovery tank is removed from the unitary body.

9. The handheld extraction cleaner of claim 1, wherein the recovery tank comprises:

an outlet opening formed in the second portion of the tank body, separate from the inlet opening; and a closure provided in the outlet opening, wherein the closure is removable to empty dirty liquid in the recovery tank.

10. The handheld extraction cleaner of claim 9, wherein the inlet opening is provided at an upper end of the first portion and the outlet opening is provided at an upper end of the second portion.

11. The handheld extraction cleaner of claim 1, wherein the recovery tank is removably mounted to the unitary body, and wherein the recovery tank comprises a spring-loaded flapper door that automatically seals the inlet opening when the recovery tank is removed from the unitary body.

12. The handheld extraction cleaner of claim 11, wherein:

the recovery system comprises a separator defining a portion of the working air path through the unitary body, the separator including a debris outlet aligned with the inlet opening to transfer dirty liquid separated from a working airstream into the recovery tank; and a flapper actuator is disposed adjacent the debris outlet to automatically open the flapper door when the recovery tank is mounted on the unitary body.

13. The handheld extraction cleaner of claim 1, wherein the inlet opening is disposed entirely above the second portion of the tank body when the extraction cleaner is at rest in the horizontal orientation on the horizontal surface to direct dirty liquid away from the inlet opening.

14. The handheld extraction cleaner of claim 1, wherein the inlet opening is disposed below at least a portion of the second portion of the tank body when the extraction cleaner is in a use position with the suction nozzle adjacent the horizontal surface.

15. The handheld extraction cleaner of claim 1, wherein the bottom surface of the recovery tank forms a bottommost portion of the extraction cleaner, and the extraction cleaner is supportable solely by the recovery tank when the extraction cleaner is at rest in the horizontal orientation on the horizontal surface.

16. The handheld extraction cleaner of claim 1, wherein the unitary body comprises:

a cleaning head including the suction nozzle;

a rearward cleaner body carrying the recovery tank; and a neck connecting the cleaning head to the rearward cleaner body.

17. The handheld extraction cleaner of claim 16, wherein the neck projects forwardly from the rearward cleaner body to support the cleaning head away from the horizontal surface when the extraction cleaner is at rest in the horizontal orientation on the horizontal surface.

18. The handheld extraction cleaner of claim 16, comprising a powered brushroll operably coupled with a brush drive motor by a drive assembly, wherein the powered brushroll and brush drive motor are located in the cleaning head, and the suction source is located in the rearward cleaner body.

19. The handheld extraction cleaner of claim 16, wherein the first portion of the recovery tank is disposed rearwardly of the cleaning head and the second portion of the recovery tank is disposed rearwardly of the first portion.

20. The handheld extraction cleaner of claim 1, wherein:

the carry handle comprises a hand grip portion and a finger receiving area;

the hand grip portion overlies the recovery tank and is non-parallel to the bottom surface of the recovery tank;

a forward portion of the hand grip portion is positioned rearward of the supply tank;

the finger receiving area is a closed volume having a perimeter; and the perimeter comprises the hand grip portion and a portion of the unitary body above the recovery tank.

* * * * *